US010543142B2

(12) United States Patent
Lim et al.

(10) Patent No.: US 10,543,142 B2
(45) Date of Patent: Jan. 28, 2020

(54) SURGICAL FRAME INCLUDING TORSO-SLING AND METHOD FOR USE THEREOF

(71) Applicant: Warsaw Orthopedic, Inc, Warsaw, IN (US)

(72) Inventors: Roy K. Lim, Germantown, TN (US); Matthew M. Morrison, Cordova, TN (US); Thomas V. McGahan, Germantown, TN (US); Richard A. Hynes, Melbourne Beach, FL (US)

(73) Assignee: Warsaw Orthopedic, Inc., Warsaw, IN (US)

( * ) Notice: Subject to any disclaimer, the term of this patent is extended or adjusted under 35 U.S.C. 154(b) by 343 days.

(21) Appl. No.: 15/674,456

(22) Filed: Aug. 10, 2017

(65) Prior Publication Data

US 2019/0046381 A1 Feb. 14, 2019

(51) Int. Cl.
*A61G 13/08* (2006.01)
*A61G 13/04* (2006.01)
(Continued)

(52) U.S. Cl.
CPC ..... *A61G 13/08* (2013.01); *A61G 7/008* (2013.01); *A61G 7/015* (2013.01); *A61G 13/04* (2013.01); *A61G 13/122* (2013.01); *A61G 7/001* (2013.01)

(58) Field of Classification Search
CPC ..... A61G 7/001; A61G 7/002; A61G 7/005; A61G 7/008; A61G 7/012; A61G 7/015;
(Continued)

(56) References Cited

U.S. PATENT DOCUMENTS 2,691,979 A 10/1954 Watson
5,390,383 A 2/1995 Carn
(Continued)

FOREIGN PATENT DOCUMENTS

WO 2007058673 A1 5/2007
WO 2017031225 A1 2/2017

*Primary Examiner* — Robert G Santos

(57) ABSTRACT

A torso-sling is provided to support at least a portion of the body of a patient on a surgical frame. The torso-sling is used in supporting at least a portion of the patient's torso. The torso-sling is supported relative to the surgical frame using a support bracket that can be attached to a chest support plate of the surgical frame. The torso-sling includes a frame portion, at least a first support strap, and at least a second support strap. The frame portion defines an access area, and the frame portion includes a first side portion, a second side portion, and a transition portion joining the first and second side portions together. The first side portion is configured for positioning adjacent a first lateral side on the posterior side of the patient, the second side portion is configured for positioning adjacent a second lateral side on the posterior side of the patient, and the transition portion is configured for positioning adjacent the neck and shoulders on the posterior side of the patient. The first support strap extends from the support bracket to the first side portion, the first support strap, when the patient is supported by the surgical frame and the torso-sling supports portions of the torso of the patient, extending in part adjacent portions of the first lateral side of the torso of the patient. The second support strap extends from the support bracket to the second side portion, the second support strap, when the patient is supported by the surgical frame and the torso-sling supports the portions of the torso of the patient, extending in part adjacent and contacting portions the second lateral side of the torso and the anterior torso of the patient.

20 Claims, 32 Drawing Sheets

(51) Int. Cl.
*A61G 7/015* (2006.01)
*A61G 7/008* (2006.01)
*A61G 13/12* (2006.01)
*A61G 7/00* (2006.01)

(58) Field of Classification Search
CPC ..... A61G 7/018; A61G 13/02; A61G 13/04; A61G 13/06; A61G 13/08; A61G 7/075; A61G 13/12; A61G 13/1205; A61G 13/121; A61G 13/122; A61G 13/1225; A61G 13/123; A61G 13/1235; A61G 13/124; A61G 13/1245; A61G 13/125; A61G 13/1255
USPC ..... 5/607–609, 600, 621–624
See application file for complete search history.

(56) References Cited

U.S. PATENT DOCUMENTS 6,112,349 A * 9/2000 Connolly ..... A61G 7/001 5/430
6,566,833 B2 * 5/2003 Bartlett ..... A61G 7/001 318/564
6,671,905 B2 * 1/2004 Bartlett ..... A61G 7/001 128/845
6,715,169 B2 * 4/2004 Niederkrom ..... A61G 7/001 5/607
6,728,983 B2 * 5/2004 Bartlett ..... A61G 7/001 5/607
6,732,390 B2 * 5/2004 Krywiczanin ..... A61G 7/001 5/607
6,874,181 B1 * 4/2005 Connolly ..... A61G 7/001 5/425
6,934,986 B2 * 8/2005 Krywiczanin ..... A61G 7/001 5/600
7,189,214 B1 3/2007 Saunders
7,219,379 B2 * 5/2007 Krywiczanin ..... A61G 7/001 5/607
7,234,180 B2 6/2007 Horton et al.
7,290,302 B2 11/2007 Sharps
7,472,440 B2 * 1/2009 Bartlett ..... A61G 7/001 5/607
7,496,980 B2 3/2009 Sharps
9,072,646 B2 * 7/2015 Skripps ..... A61G 13/04
9,937,006 B2 * 4/2018 Skripps ..... A61G 13/04
10,314,758 B2 * 6/2019 Dolliver ..... A61G 13/04
2002/0138905 A1 * 10/2002 Bartlett ..... A61G 7/001 5/607
2002/0138906 A1 * 10/2002 Bartlett ..... A61G 7/001 5/609
2003/0140419 A1 * 7/2003 Bartlett ..... A61G 7/001 5/607
2003/0140420 A1 * 7/2003 Niederkrom ..... A61G 7/001 5/607
2003/0145382 A1 * 8/2003 Krywiczanin ..... A61G 7/001 5/607
2004/0010849 A1 * 1/2004 Krywiczanin ..... A61G 7/001 5/607
2006/0037141 A1 * 2/2006 Krywiczanin ..... A61G 7/001 5/607
2006/0162076 A1 * 7/2006 Bartlett ..... A61G 7/001 5/607
2008/0134434 A1 6/2008 Celauro
2010/0037397 A1 2/2010 Wood
2012/0144589 A1 * 6/2012 Skripps ..... A61G 13/04 5/624
2012/0144689 A1 6/2012 Skripps et al.
2013/0111666 A1 5/2013 Jackson
2014/0109316 A1 4/2014 Jackson et al.
2015/0272681 A1 * 10/2015 Skripps ..... A61G 13/04 128/854
2016/0047394 A1 2/2016 Lee
2017/0027797 A1 * 2/2017 Dolliver ..... A61G 13/04
2017/0049651 A1 2/2017 Lim et al.
2017/0049653 A1 2/2017 Lim et al.
2018/0363596 A1 * 12/2018 Lim ..... F02M 31/183
2019/0000702 A1 * 1/2019 Lim ..... A61G 7/1017
2019/0000707 A1 * 1/2019 Lim ..... A61G 13/08
2019/0046381 A1 * 2/2019 Lim ..... A61G 13/04
2019/0046383 A1 * 2/2019 Lim ..... A61G 13/04

* cited by examiner

SURGICAL FRAME INCLUDING TORSO-SLING AND METHOD FOR USE THEREOF

BACKGROUND OF THE INVENTION

Field of the Invention

The present invention relates to a surgical frame incorporating a torso-sling for supporting the torso of a patient. More particularly, the present invention relates to a surgical frame incorporating a torso-sling configured to facilitate hanging the torso of the patient on the surgical frame. More specifically, the present invention relates to a surgical frame incorporating a torso-sling that includes a support frame and support straps for hanging the torso of the patient relative to the remainder of the surgical frame.

Description of the Prior Art

Typically, surgical frames rely solely on torso supports contacting the chest of a patient in combination with support straps to support the torso of the patient. The chest of the patient is contacted with the torso support, and the support straps are wound around the patient and the torso support to secure the patient's torso to the surgical frame. Securement of the patient's torso to the surgical frame in this manner can (when using a specially-configured surgical frame) facilitate repositioning of the patient between prone and lateral positions. Use of support straps in this manner, however, can cover portions of the back and lateral sides of the patient, thus interfering with access thereto. Therefore, there is a need for a torso-sling that incorporates a support frame in combination with support straps that facilitate attachment to the remainder of the surgical frame, while also providing at least access to the back of the patient.

SUMMARY OF THE INVENTION

The present invention in one preferred embodiment contemplates a surgical frame for supporting a patient including a main beam for supporting at least a portion of the body of the patient relative thereto, the main beam including a first end, a second end, and a length extending between the first and second ends, a first arm support and a second arm support attached to the main beam, the first and second arm supports configured to support portions of the arms of the patient, a leg support attached to the main beam, the leg support configured to support portions of the legs of the patient; a chest support plate and a torso-sling including a support bracket configured to support portions of the torso of the patient, the chest support plate being attached to the main beam, the support bracket being attached to the chest support plate, and the torso-sling being supported by the support bracket, the torso-sling being configured to support portions of the torso of the patient, the torso-sling including a frame portion, at least a first support strap, and at least a second support strap, the frame portion including a first side portion, a second side portion, and a transition portion joining the first and second side portions together, the first side portion being configured for positioning adjacent a first lateral side on the posterior side of the patient, the second side portion being configured for positioning adjacent a second lateral side on the posterior side of the patient, and the transition portion being configured for positioning adjacent the neck and shoulders on the posterior side of the patient, the first support strap extending from the support bracket to the first side portion, the first support strap, when the patient is supported by the surgical frame and the torso-sling supports the portions of the torso of the patient, extending in part adjacent portions of the first lateral side of the torso of the patient, the second support strap extending from the support bracket to the second side portion, the second support strap, when the patient is supported by the surgical frame and the torso-sling supports the portions of the torso of the patient, extending in part adjacent and contacting portions the second lateral side of the torso and the anterior torso of the patient.

The present invention in another preferred embodiment contemplates a surgical frame for supporting a patient including a main beam for supporting at least a portion of the body of the patient relative thereto, the main beam including a first end, a second end, and a length extending between the first and second ends, a chest support plate and a torso-sling including a support bracket configured to support portions of the torso of the patient, the chest support plate being attached to the main beam, the support bracket being attached to the chest support plate, and the torso-sling being supported by the support bracket, the torso-sling being configured to support portions of the torso of the patient, the torso-sling including a frame portion, at least a first support strap, and at least a second support strap, the frame portion including a first side portion, a second side portion, and a transition portion joining the first and second side portions together, the first side portion being configured for positioning adjacent a first lateral side on the posterior side of the patient, the second side portion being configured for positioning adjacent a second lateral side on the posterior side of the patient, and the transition portion being configured for positioning adjacent the neck and shoulders on the posterior side of the patient, the first side portion, the second side portion, and the transition portion defining an access area therebetween, the access area, when the patient is supported by the torso-sling, affording access to the posterior torso of the patient, the first support strap extending from the support bracket to the first side portion, the first support strap, when the patient is supported by the surgical frame and the torso-sling supports the portions of the torso of the patient, extending in part adjacent portions of the first lateral side of the torso of the patient, the second support strap extending from the support bracket to the second side portion, the second support strap, when the patient is supported by the surgical frame and the torso-sling supports the portions of the torso of the patient, extending in part adjacent and contacting portions the second lateral side of the torso and the anterior torso of the patient.

The present invention in yet another preferred embodiment contemplates a surgical frame for supporting a patient including a main beam for supporting at least a portion of the body of the patient relative thereto, the main beam including a first end, a second end, and a length extending between the first and second ends, a chest support plate and a torso-sling including a support bracket configured to support portions of the torso of the patient, the chest support plate being attached to the main beam, and the torso-sling being supported relative to the chest support plate, the torso-sling being configured to support portions of the torso of the patient, the torso-sling including a frame portion, at least a first support strap, and at least a second support strap, the frame portion including a first side portion for positioning adjacent a first lateral side of the patient, a second side portion for positioning adjacent a second lateral side of the patient, and a transition portion joining the first and second side portions together, the first side portion, the second side portion, and the transition portion defining an access area therebetween, the access area, when the patient is supported by the torso-sling, affording access to the posterior torso of the patient, the first support strap extending from the support bracket to the first side portion, the first support strap, when the patient is supported by the surgical frame and the torso-sling supports the portions of the torso of the patient, extending in part adjacent portions of the first lateral side of the torso of the patient, the second support strap extending from the support bracket to the second side portion, the second support strap, when the patient is supported by the surgical frame and the torso-sling supports the portions of the torso of the patient, extending in part adjacent and contacting portions the second lateral side of the torso and the anterior torso of the patient.

These and other objects of the present invention will be apparent from a review of the following specification and the accompanying drawings.

DETAILED DESCRIPTION OF THE PREFERRED EMBODIMENT

Figure 1:
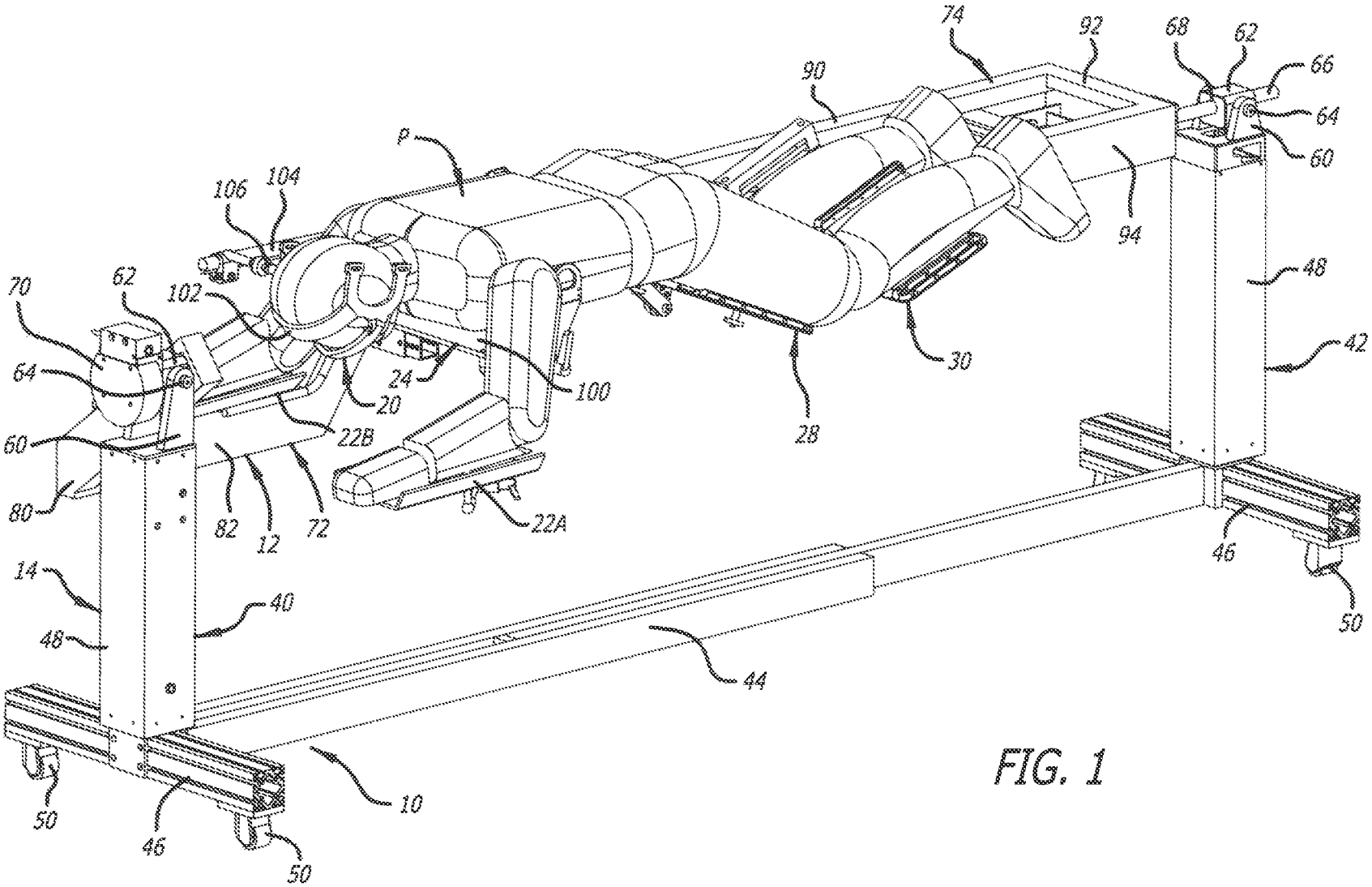
FIG. 1 is a top perspective view of a prior art surgical frame with a patient positioned thereon in a prone position.
Figure 2:
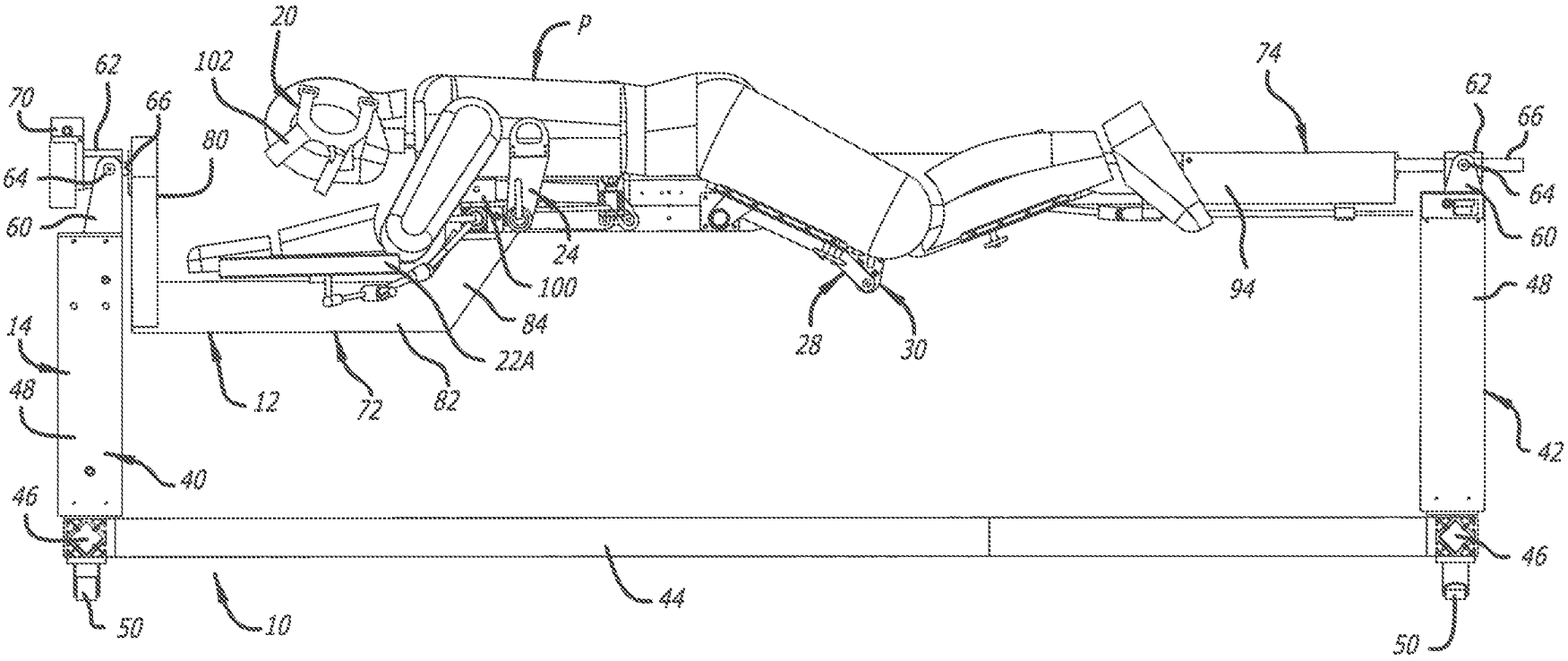
FIG. 2 is a side elevational view of the surgical frame of FIG. 1 with the patient positioned thereon in a prone position.
Figure 3:
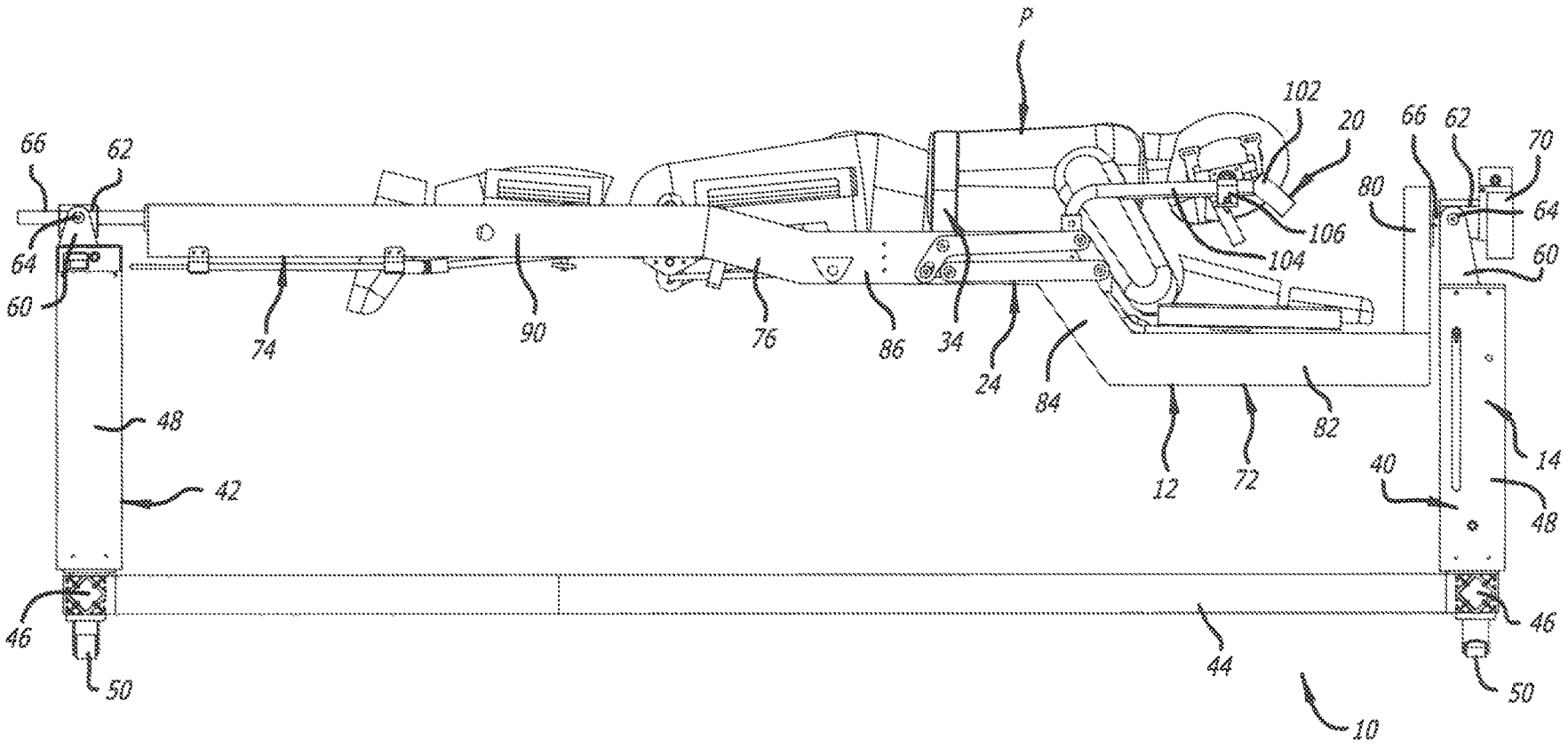
FIG. 3 is another side elevational view of the surgical frame of FIG. 1 with the patient positioned thereon in a prone position.

FIGS. 1-26 depict a prior art embodiment and components of a surgical support frame generally indicated by the numeral 10. FIGS. 1-26 were previously described in U.S. Ser. No. 15/239,256, which is hereby incorporated by reference herein in its entirety. As discussed below, the surgical frame 10 serves as an exoskeleton to support the body of the patient P as the patient's body is manipulated thereby, and, in doing so, serves to support the patient P such that the patient's spine does not experience unnecessary torsion.

The surgical frame 10 is configured to provide a relatively minimal amount of structure adjacent the patient's spine to facilitate access thereto and to improve the quality of imaging available before and during surgery. Thus, the surgeon's workspace and imaging access are thereby increased. Furthermore, radio-lucent or low magnetic susceptibility materials can be used in constructing the structural components adjacent the patient's spine in order to further enhance imaging quality.

The surgical frame 10 has a longitudinal axis and a length therealong. As depicted in FIGS. 1-5, for example, the surgical frame 10 includes an offset structural main beam 12 and a support structure 14. The offset main beam 12 is spaced from the ground by the support structure 14. As discussed below, the offset main beam 12 is used in supporting the patient P on the surgical frame 10 and various support components of the surgical frame 10 that directly contact the patient P (such as a head support 20, arm supports 22A and 22B, torso-lift supports 24 and 160, a sagittal adjustment assembly 28 including a pelvic-tilt mechanism 30 and a leg adjustment mechanism 32, and a coronal adjustment assembly 34). As discussed below, an operator such as a surgeon can control actuation of the various support components to manipulate the position of the patient's body. Soft straps (not shown) are used with these various support components to secure the patient P to the frame and to enable either manipulation or fixation of the patient P. Reusable soft pads can be used on the load-bearing areas of the various support components.

Figure 4:
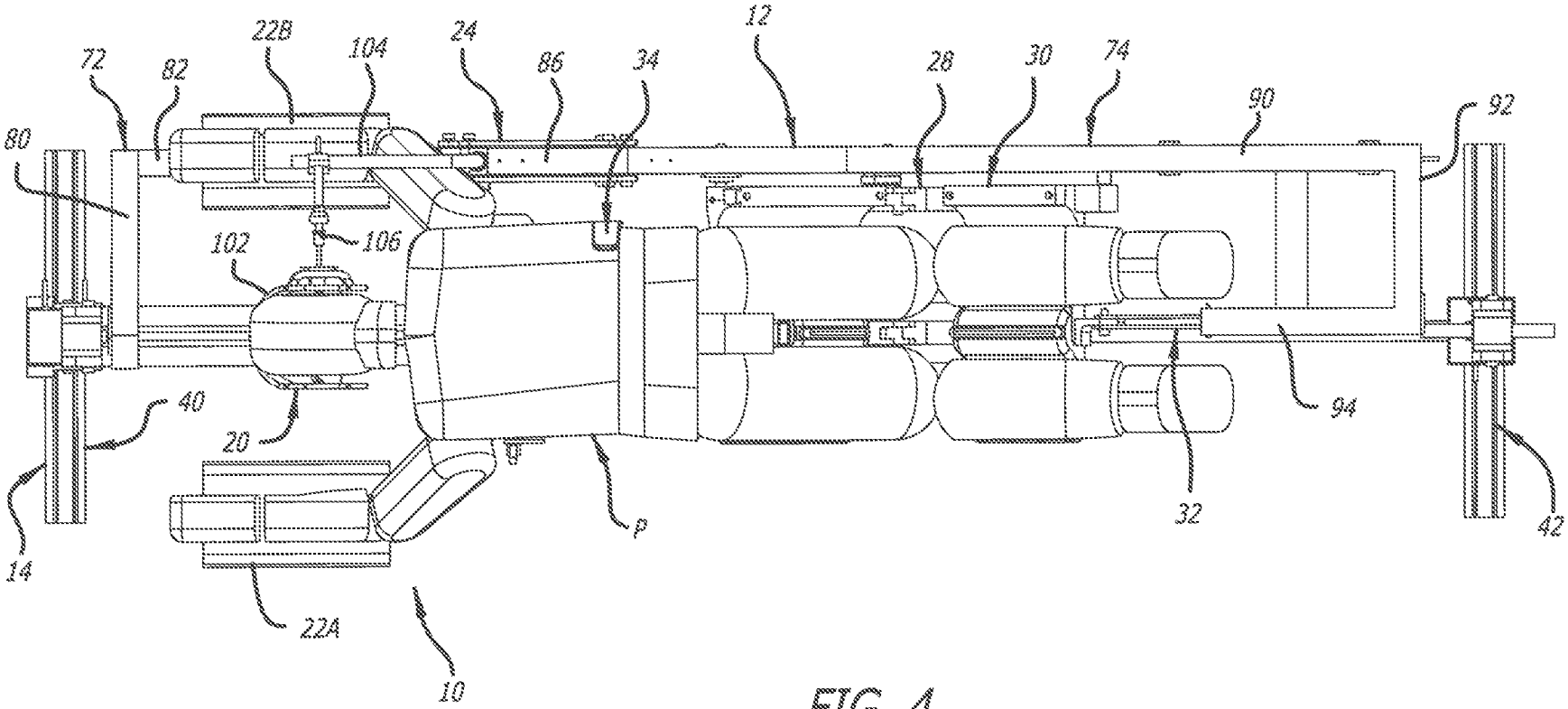
FIG. 4 is a top plan view of the surgical frame of FIG. 1 with the patient positioned thereon in a prone position.
Figure 5:
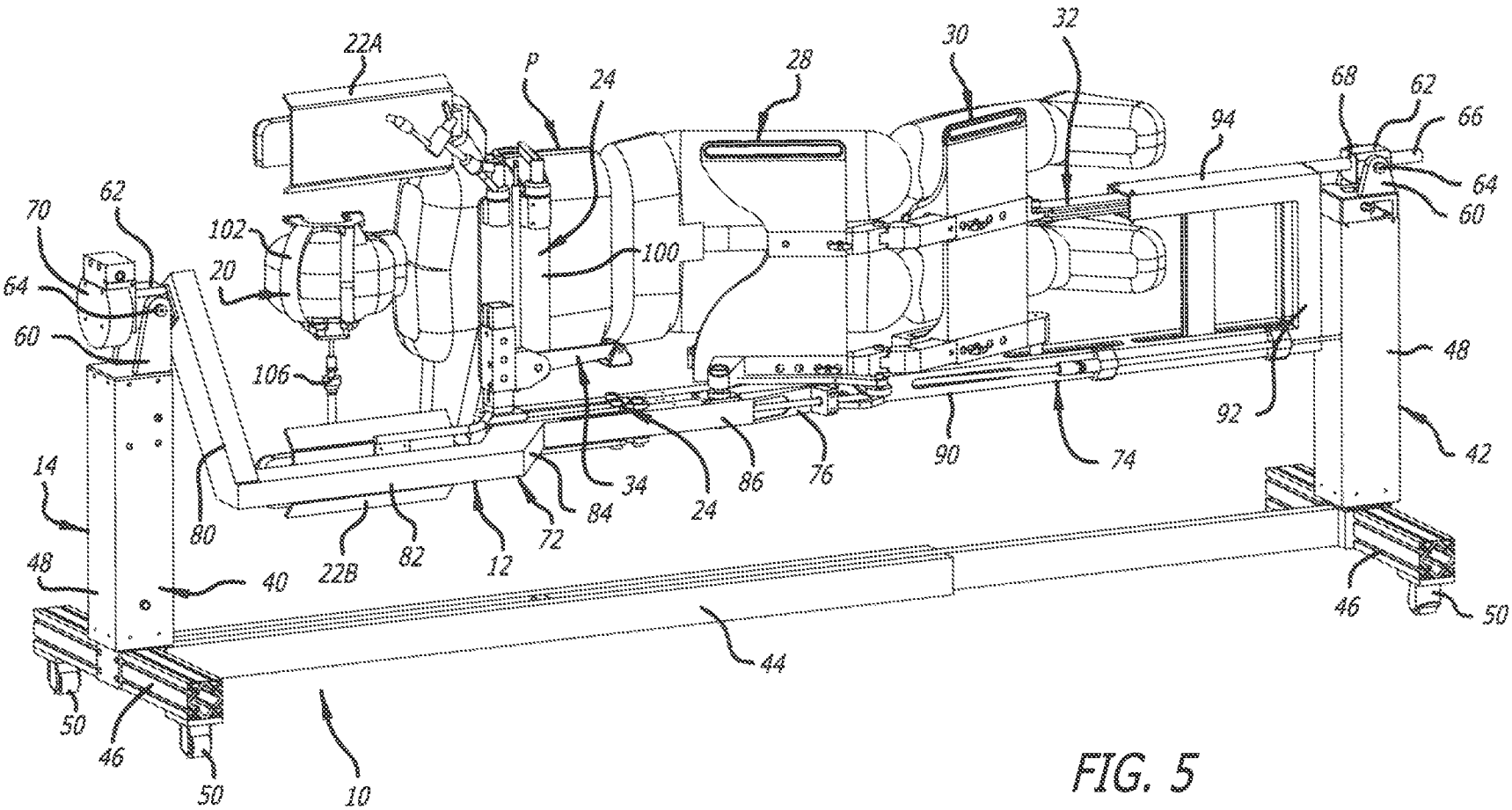
FIG. 5 is a top perspective view of the surgical frame of FIG. 1 with the patient positioned thereon in a lateral position.

The offset main beam 12 is used to facilitate rotation of the patient P. The offset main beam 12 can be rotated a full 360° before and during surgery to facilitate various positions of the patient P to afford various surgical pathways to the patient's spine depending on the surgery to be performed. For example, the offset main beam 12 can be positioned to place the patient P in a prone position (e.g., FIGS. 1-4), a lateral position (e.g., FIG. 5), and in a position 45° between the prone and lateral positions. Furthermore, the offset main beam 12 can be rotated to afford anterior, posterior, lateral, anterolateral, and posterolateral pathways to the spine. As such, the patient's body can be flipped numerous times before and during surgery without compromising sterility or safety. The various support components of the surgical frame 10 are strategically placed to further manipulate the patient's body into position before and during surgery. Such intraoperative manipulation and positioning of the patient P affords a surgeon significant access to the patient's body. To illustrate, when the offset main beam 12 is rotated to position the patient P in a lateral position, as depicted in FIG. 5, the head support 20, the arm supports 22A and 22B, the torso-lift support 24, the sagittal adjustment assembly 28, and/or the coronal adjustment assembly 34 can be articulated such that the surgical frame 10 is OLIF-capable or DLIF-capable.

As depicted in FIG. 1, for example, the support structure 14 includes a first support portion 40 and a second support portion 42 interconnected by a cross member 44. Each of the first and second support portions 40 and 42 include a horizontal portion 46 and a vertical support post 48. The horizontal portions 46 are connected to the cross member 44, and casters 50 can be attached to the horizontal portions 46 to facilitate movement of the surgical frame 10.

The vertical support posts 48 can be adjustable to facilitate expansion and contraction of the heights thereof. Expansion and contraction of the vertical support posts 48 facilitates raising and lowering, respectively, of the offset main beam 12. As such, the vertical support posts 48 can be adjusted to have equal or different heights. For example, the vertical support posts 48 can be adjusted such that the vertical support post 48 of the second support portion 42 is raised 12 inches higher than the vertical support post 48 of the first support portion 40 to place the patient P in a reverse Trendelenburg position.

Furthermore, cross member 44 can be adjustable to facilitate expansion and contraction of the length thereof. Expansion and contraction of the cross member 44 facilitates lengthening and shortening, respectively, of the distance between the first and second support portions 40 and 42.

The vertical support post 48 of the first and second support portions 40 and 42 have heights at least affording rotation of the offset main beam 12 and the patient P positioned thereon. Each of the vertical support posts 48 include a clevis 60, a support block 62 positioned in the clevis 60, and a pin 64 pinning the clevis 60 to the support block 62. The support blocks 62 are capable of pivotal movement relative to the clevises 60 to accommodate different heights of the vertical support posts 48. Furthermore, axles 66 extending outwardly from the offset main beam 12 are received in apertures 68 formed the support blocks 62. The axles 66 define an axis of rotation of the offset main beam 12, and the interaction of the axles 66 with the support blocks 62 facilitate rotation of the offset main beam 12.

Furthermore, a servomotor 70 can be interconnected with the axle 66 received in the support block 62 of the first support portion 40. The servomotor 70 can be computer controlled and/or operated by the operator of the surgical frame 10 to facilitate controlled rotation of the offset main beam 12. Thus, by controlling actuation of the servomotor 70, the offset main beam 12 and the patient P supported thereon can be rotated to afford the various surgical pathways to the patient's spine.

As depicted in FIGS. 1-5, for example, the offset main beam 12 includes a forward portion 72 and a rear portion 74. The forward portion 72 supports the head support 20, the arm supports 22A and 22B, the torso-lift support 24, and the coronal adjustment assembly 34, and the rear portion 74 supports the sagittal adjustment assembly 28. The forward and rear portions 72 and 74 are connected to one another by connection member 76 shared therebetween. The forward portion 72 includes a first portion 80, a second portion 82, a third portion 84, and a fourth portion 86. The first portion 80 extends transversely to the axis of rotation of the offset main beam 12, and the second and fourth portions 82 and 86 are aligned with the axis of rotation of the offset main beam 12. The rear portion 74 includes a first portion 90, a second portion 92, and a third portion 94. The first and third portions 90 and 94 are aligned with the axis of rotation of the offset main beam 12, and the second portion 92 extends transversely to the axis of rotation of the offset main beam 12.

The axles 66 are attached to the first portion 80 of the forward portion 72 and to the third portion 94 of the rear portion 74. The lengths of the first portion 80 of the forward portion 72 and the second portion 92 of the rear portion 74 serve in offsetting portions of the forward and rear portions 72 and 74 from the axis of rotation of the offset main beam 12. This offset affords positioning of the cranial-caudal axis of patient P approximately aligned with the axis of rotation of the offset main beam 12.

Programmable settings controlled by a computer controller (not shown) can be used to maintain an ideal patient height for a working position of the surgical frame 10 at a near-constant position through rotation cycles, for example, between the patient positions depicted in FIGS. 1 and 5. This allows for a variable axis of rotation between the first portion 40 and the second portion 42.

Figure 6:
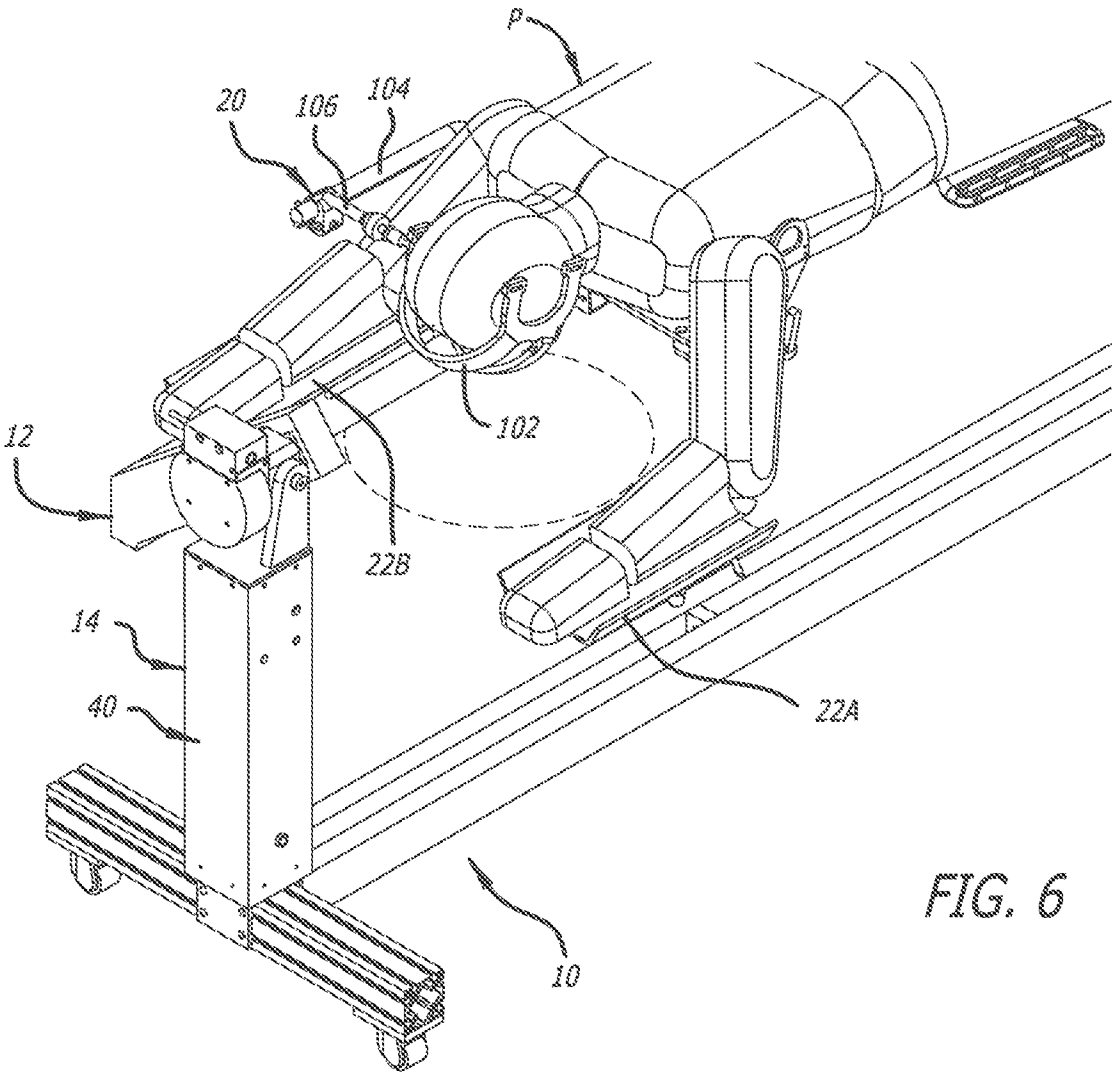
FIG. 6 is a top perspective view of portions of the surgical frame of FIG. 1 showing an area of access to the head of the patient positioned thereon in a prone position.

As depicted in FIG. 5, for example, the head support 20 is attached to a chest support plate 100 of the torso-lift support 24 to support the head of the patient P. If the torso-lift support 24 is not used, the head support 20 can be directly attached to the forward portion 72 of the offset main beam 12. As depicted in FIGS. 4 and 6, for example, the head support 20 further includes a facial support cradle 102, an axially adjustable head support beam 104, and a temple support portion 106. Soft straps (not shown) can be used to secure the patient P to the head support 20. The facial support cradle 102 includes padding across the forehead and cheeks, and provides open access to the mouth of the patient P. The head support 20 also allows for imaging access to the cervical spine. Adjustment of the head support 20 is possible via adjusting the angle and the length of the head support beam 104 and the temple support portion 106.

As depicted in FIG. 5, for example, the arm supports 22A and 22B contact the forearms and support the remainder of the arms of the patient P, with the first arm support 22A and the second arm support 22B attached to the chest support plate 100 of the torso-lift support 24. If the torso-lift support 24 is not used, the arm supports 22A and 22B can both be directly attached to the offset main beam 12. The arm supports 22A and 22B are positioned such that the arms of the patient P are spaced away from the remainder of the patient's body to provide access (FIG. 6) to at least portions of the face and neck of the patient P, thereby providing greater access to the patient.

Figure 7:
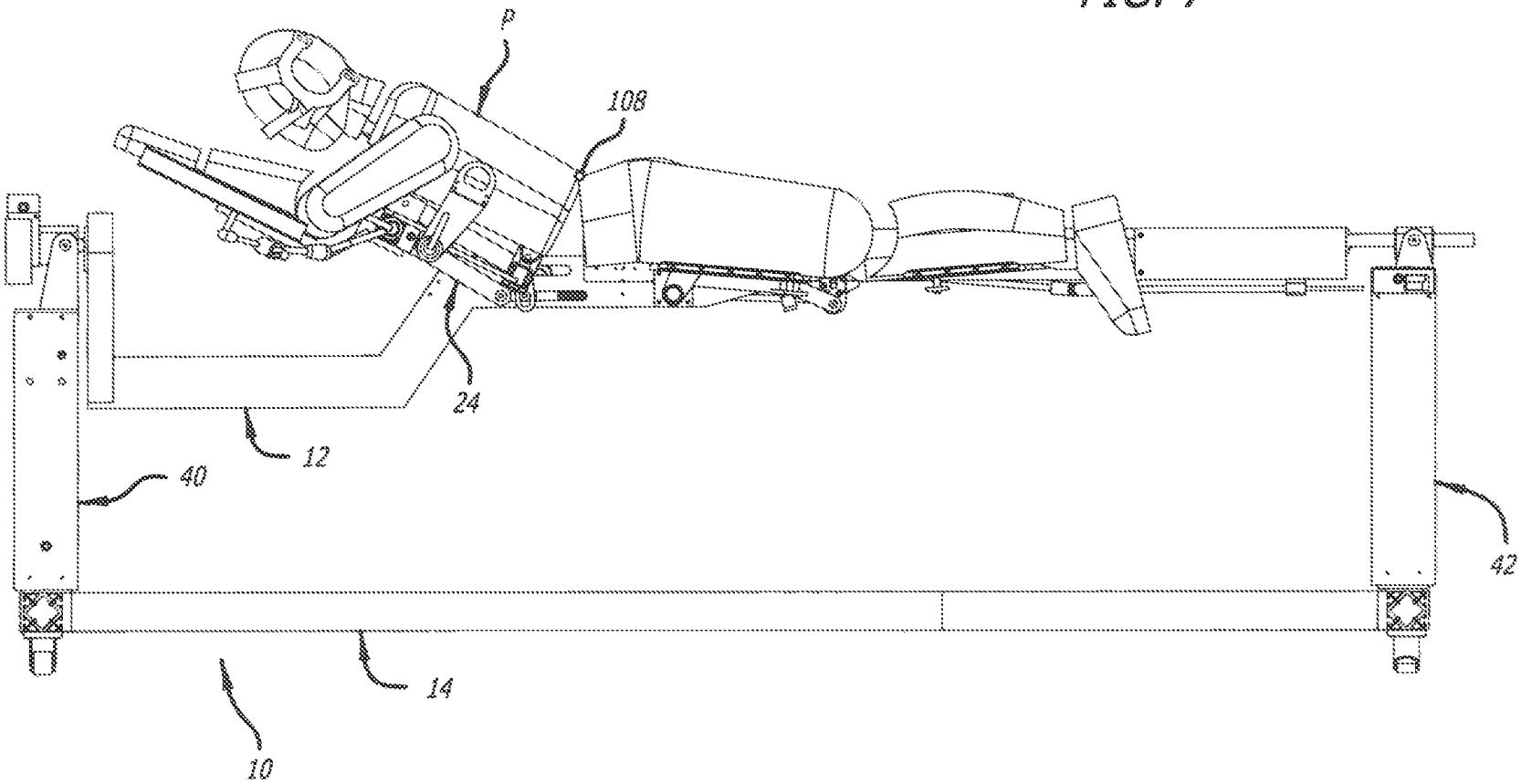
FIG. 7 is a side elevational view of the surgical frame of FIG. 1 showing a torso-lift support supporting the patient in a lifted position.
Figure 8:
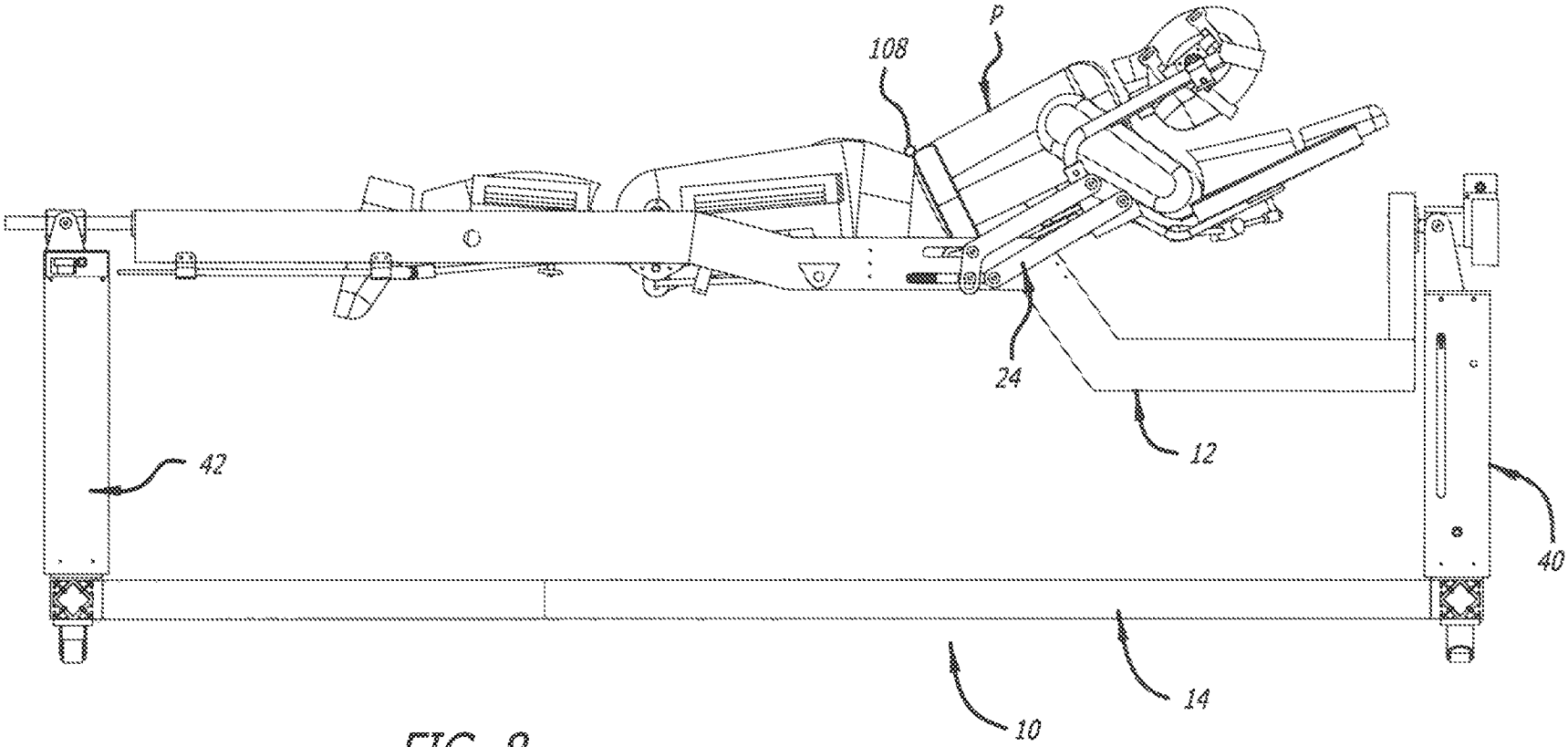
FIG. 8 is another side elevational view of the surgical frame of FIG. 1 showing the torso-lift support supporting the patient in the lifted position.
Figure 9:
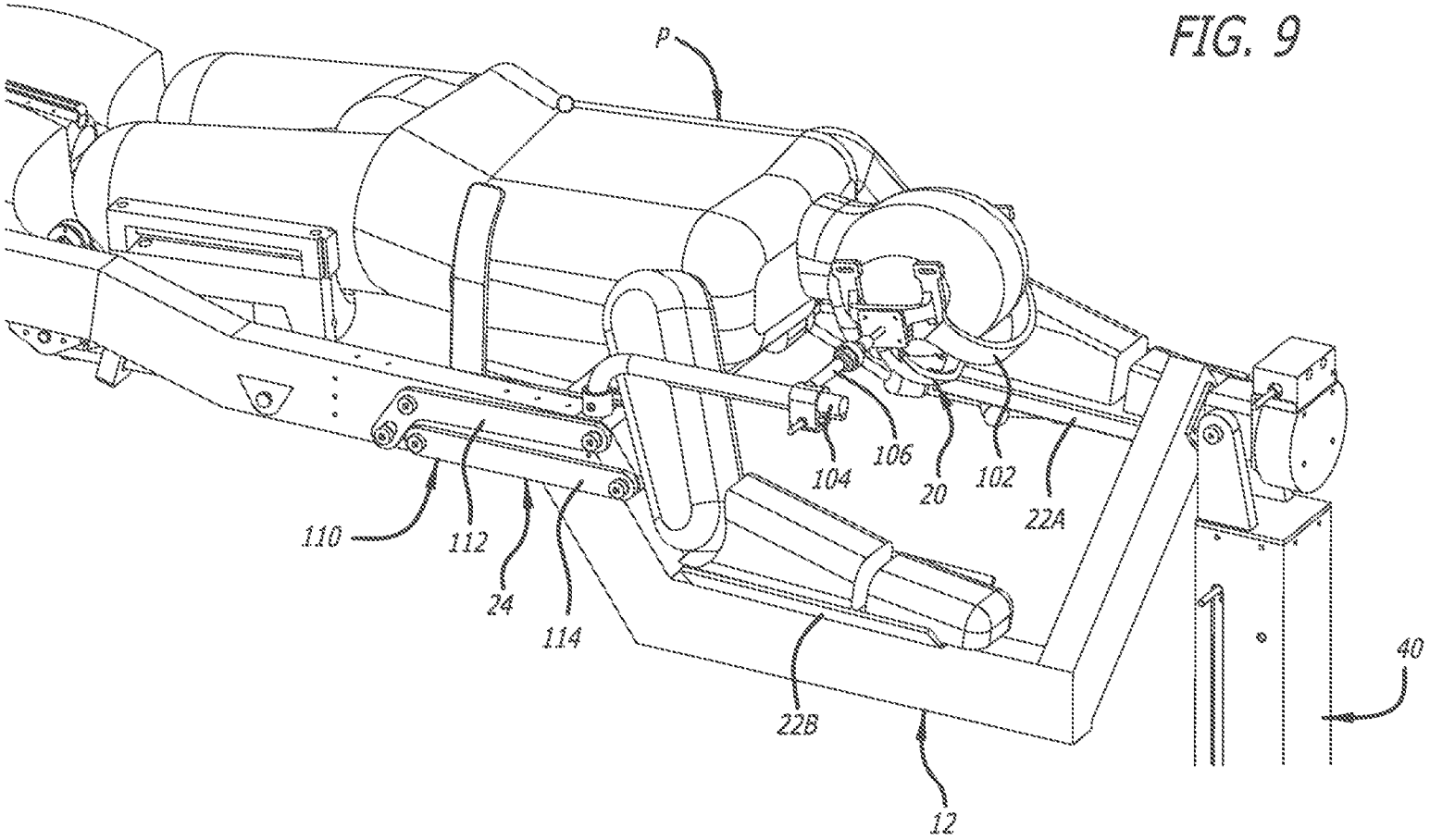
FIG. 9 is an enlarged top perspective view of portions of the surgical frame of FIG. 1 showing the torso-lift support supporting the patient in an unlifted position.

As depicted in FIGS. 7-12, for example, the surgical frame 10 includes a torso-lift capability for lifting and lowering the torso of the patient P between an uplifted position and a lifted position, which is described in detail below with respect to the torso-lift support 24. As depicted in FIGS. 7 and 8, for example, the torso-lift capability has an approximate center of rotation ("COR") 108 that is located at a position anterior to the patient's spine about the L2 of the lumbar spine, and is capable of elevating the upper body of the patient at least an additional six inches when measured at the chest support plate 100.

As depicted in FIGS. 9-12, for example, the torso-lift support 24 includes a "crawling" four-bar mechanism 110 attached to the chest support plate 100. Soft straps (not shown) can be used to secure the patient P to the chest support plate 100. The head support 20 and the arm supports 22A and 22B are attached to the chest support plate 100, thereby moving with the chest support plate 100 as the chest support plate 100 is articulated using the torso-lift support 24. The fixed COR 108 is defined at the position depicted in FIGS. 7 and 8. Appropriate placement of the COR 108 is important so that spinal cord integrity is not compromised (i.e., overly compressed or stretched) during the lift maneuver performed by the torso-lift support 24.

Figure 10:
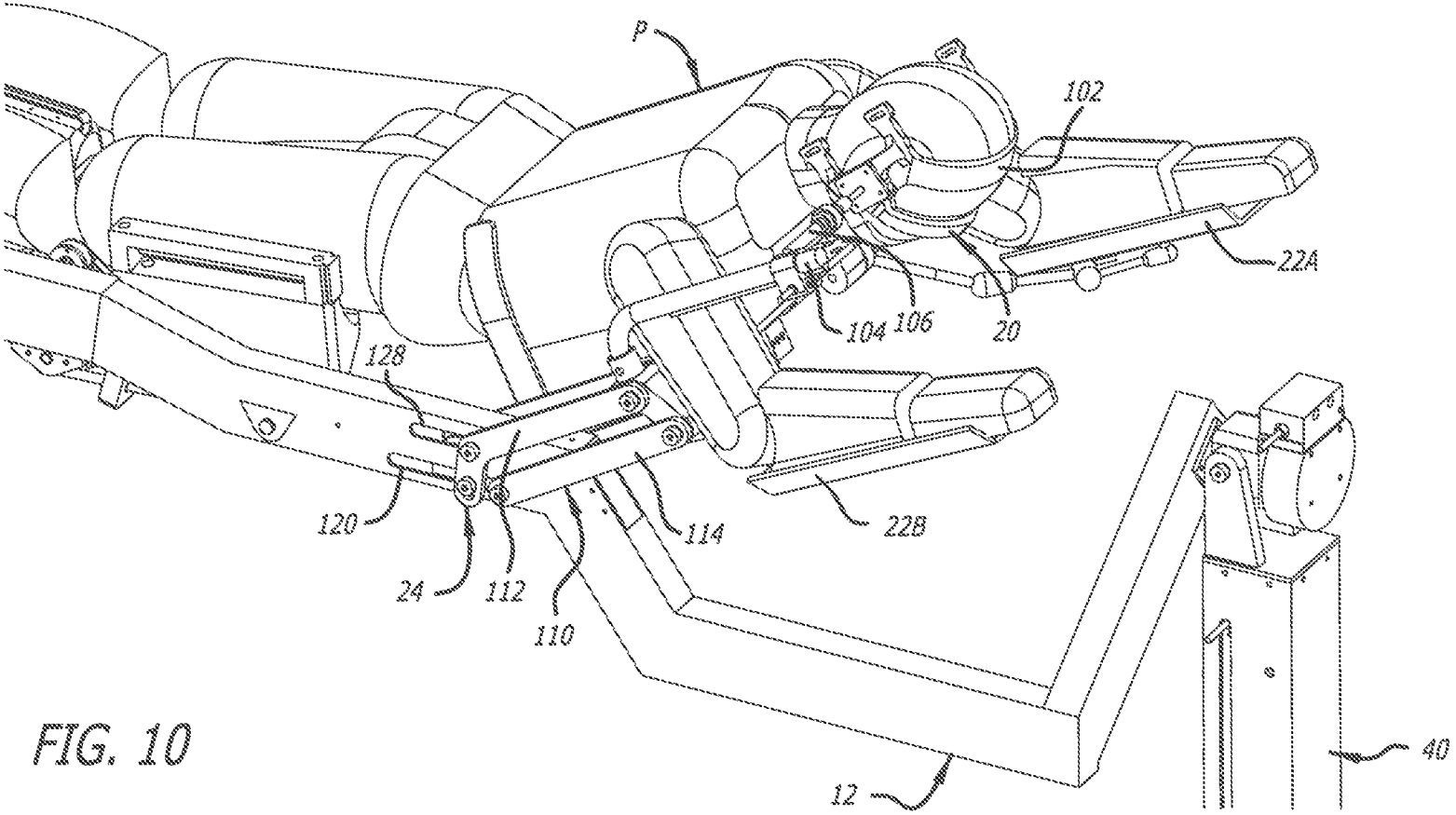
FIG. 10 is an enlarged top perspective view of portions of the surgical frame of FIG. 1 showing the torso-lift support supporting the patient in the lifted position.
Figure 11:
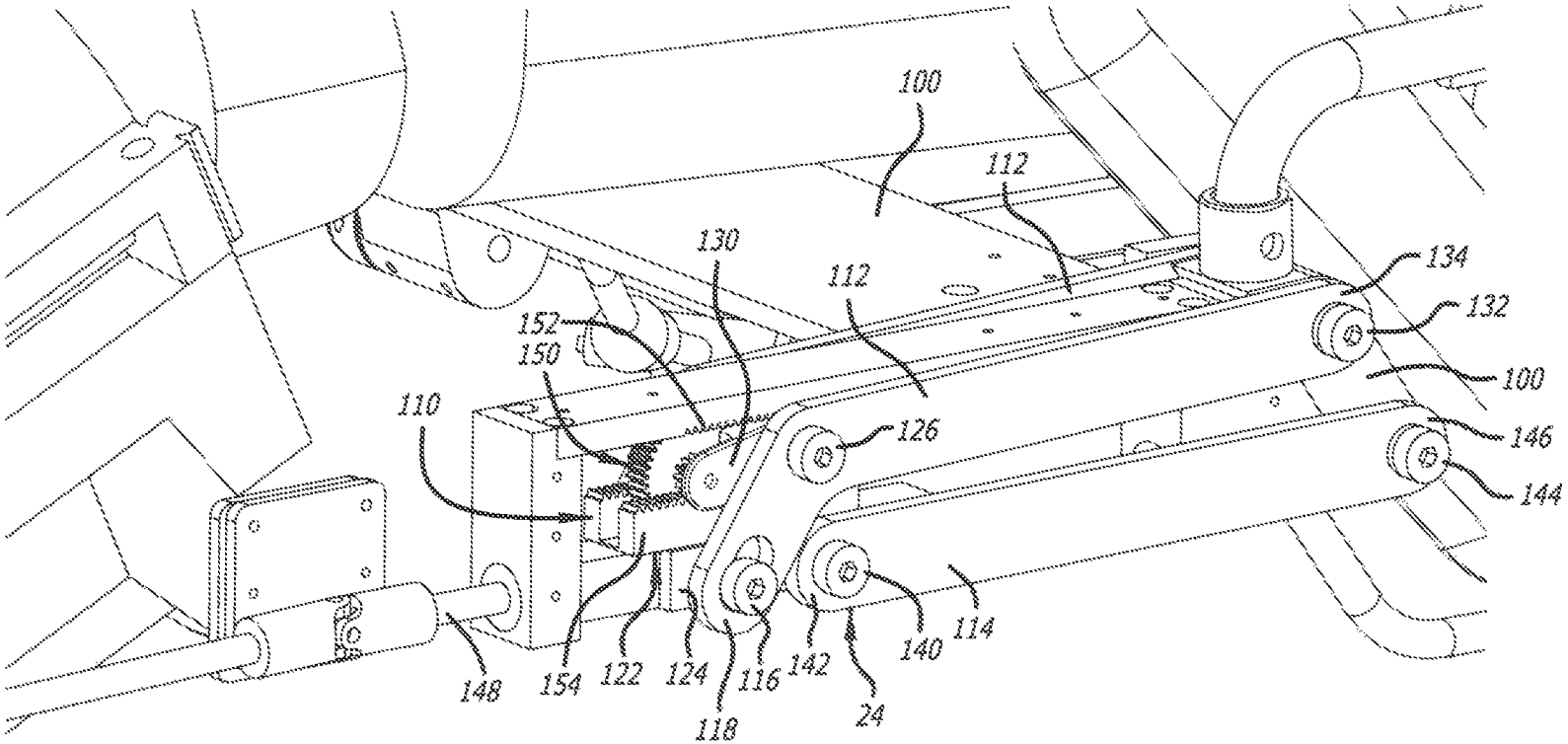
FIG. 11 is an enlarged top perspective view of componentry of the torso-lift support in the unlifted position.
Figure 12:
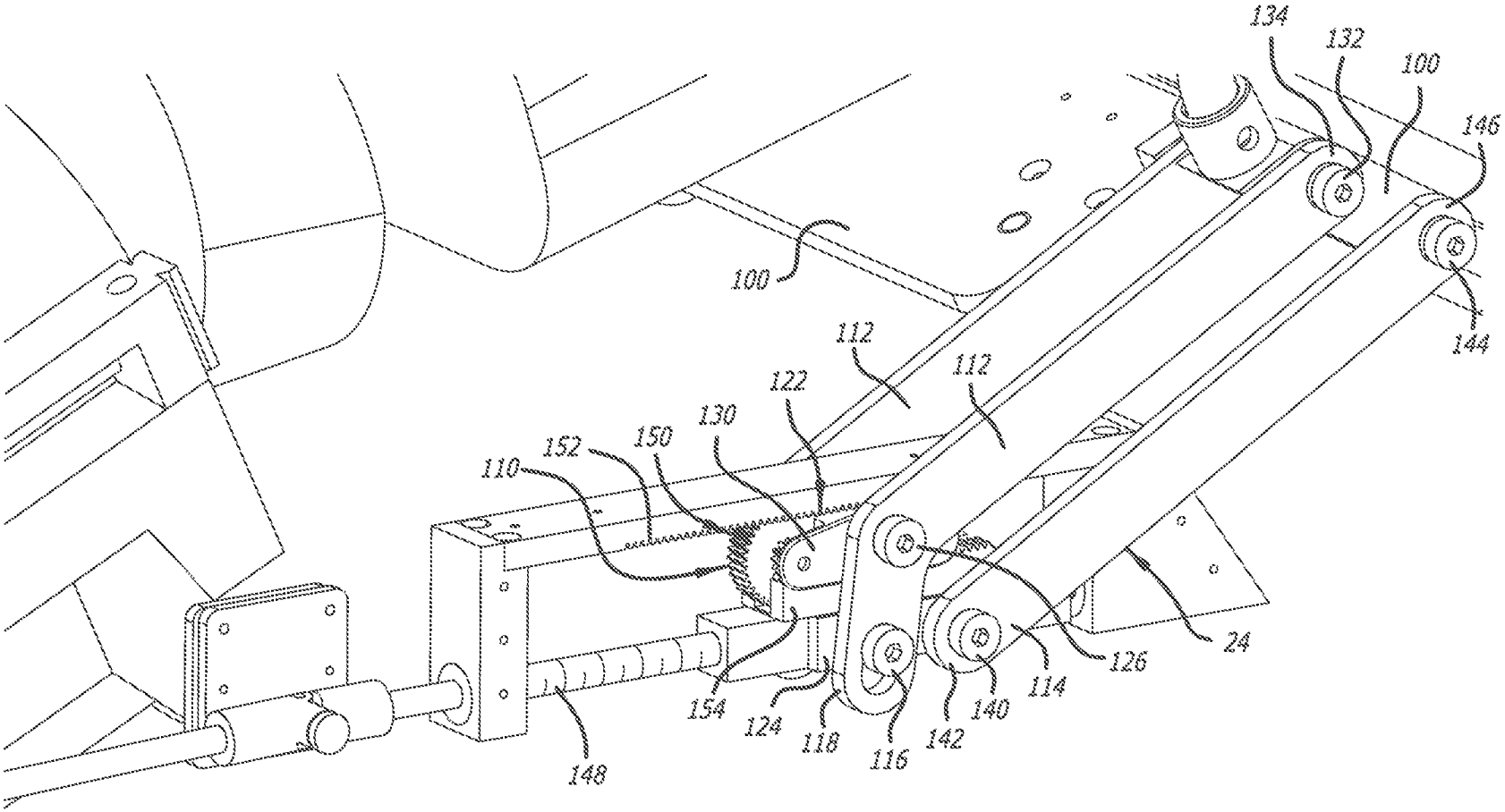
FIG. 12 is an enlarged top perspective view of the componentry of the torso-lift support in the lifted position.

As depicted in FIGS. 10-12, for example, the four-bar mechanism 110 includes first links 112 pivotally connected between offset main beam 12 and the chest support plate 100, and second links 114 pivotally connected between the offset main beam 12 and the chest support plate 100. As depicted in FIGS. 11 and 12, for example, in order to maintain the COR 108 at the desired fixed position, the first and second links 112 and 114 of the four-bar mechanism 110 crawl toward the first support portion 40 of the support structure 14, when the patient's upper body is being lifted. The first and second links 112 and 114 are arranged such that neither the surgeon's workspace nor imaging access are compromised while the patient's torso is being lifted.

As depicted in FIGS. 11 and 12, for example, each of the first links 112 define an L-shape, and includes a first pin 116 at a first end 118 thereof. The first pin 116 extends through first elongated slots 120 defined in the offset main beam 12, and the first pin 116 connects the first links 112 to a dual rack and pinion mechanism 122 via a drive nut 124 provided within the offset main beam 12, thus defining a lower pivot point thereof. Each of the first links 112 also includes a second pin 126 positioned proximate the corner of the L-shape. The second pin 126 extends through second elongated slots 128 defined in the offset main beam 12, and is linked to a carriage 130 of rack and pinion mechanism 122. Each of the first links 112 also includes a third pin 132 at a second end 134 that is pivotally attached to chest support plate 100, thus defining an upper pivot point thereof.

As depicted in FIGS. 11 and 12, for example, each of the second links 114 includes a first pin 140 at a first end 142 thereof. The first pin 140 extends through the first elongated slot 120 defined in the offset main beam 12, and the first pin 140 connects the second links 114 to the drive nut 124 of the rack and pinion mechanism 122, thus defining a lower pivot point thereof. Each of the second links 114 also includes a second pin 144 at a second end 146 that is pivotally connected to the chest support plate 100, thus defining an upper pivot point thereof.

As depicted in FIGS. 11 and 12, the rack and pinion mechanism 122 includes a drive screw 148 engaging the drive nut 124. Coupled gears 150 are attached to the carriage 130. The larger of the gears 150 engage an upper rack 152 (fixed within the offset main beam 12), and the smaller of the gears 150 engage a lower rack 154. The carriage 130 is defined as a gear assembly that floats between the two racks 152 and 154.

As depicted in FIGS. 11 and 12, the rack and pinion mechanism 122 converts rotation of the drive screw 148 into linear translation of the first and second links 112 and 114 in the first and second elongated slots 120 and 128 toward the first portion 40 of the support structure 14. As the drive nut 124 translates along drive screw 148 (via rotation of the drive screw 148), the carriage 130 translates towards the first portion 40 with less travel due to the different gear sizes of the coupled gears 150. The difference in travel, influenced by different gear ratios, causes the first links 112 pivotally attached thereto to lift the chest support plate 100. Lowering of the chest support plate 100 is accomplished by performing this operation in reverse. The second links 114 are "idler" links (attached to the drive nut 124 and the chest support plate 100) that controls the tilt of the chest support plate 100 as it is being lifted and lowered. All components associated with lifting while tilting the chest plate predetermine where COR 108 resides. Furthermore, a servomotor (not shown) interconnected with the drive screw 148 can be computer controlled and/or operated by the operator of the surgical frame 10 to facilitate controlled lifting and lowering of the chest support plate 100. A safety feature can be provided, enabling the operator to read and limit a lifting and lowering force applied by the torso-lift support 24 in order to prevent injury to the patient P. Moreover, the torso-lift support 24 can also include safety stops (not shown) to prevent over-extension or compression of the patient P, and sensors (not shown) programmed to send patient position feedback to the safety stops.

Figure 13A:
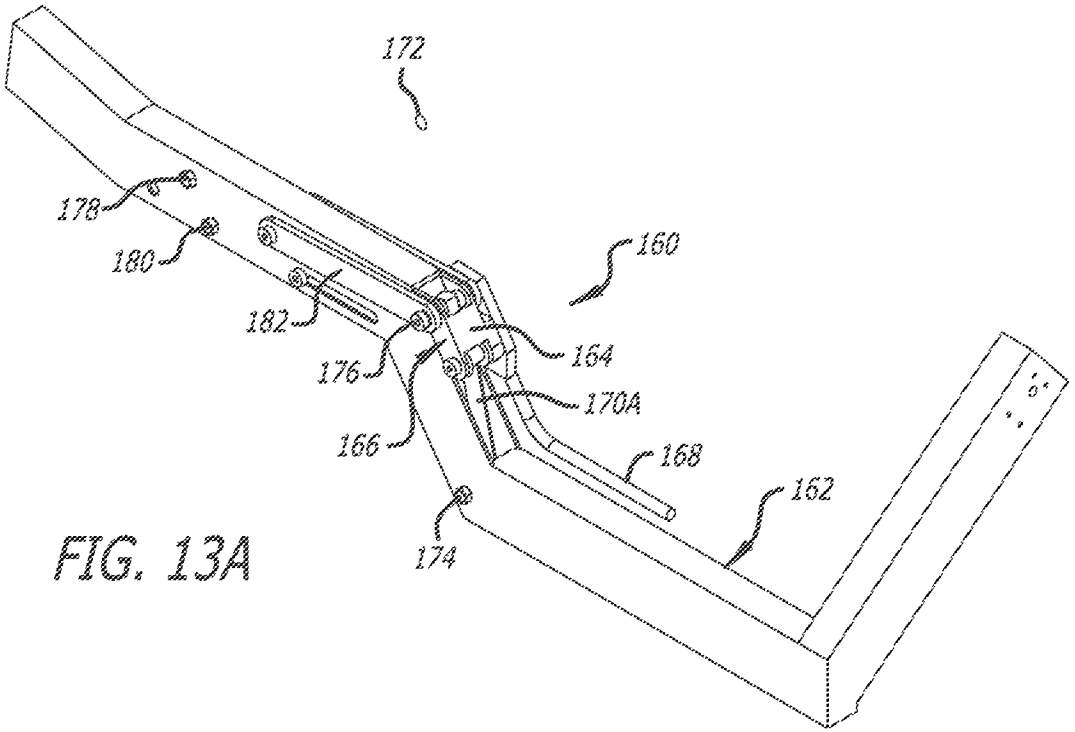
FIG. 13A is a perspective view of an embodiment of a structural offset main beam for use with another embodiment of a torso-lift support showing the torso-lift support in a retracted position.

An alternative preferred embodiment of a torso-lift support is generally indicated by the numeral 160 in FIGS. 13A-15. As depicted in FIGS. 13A-13C, an alternate offset main beam 162 is utilized with the torso-lift support 160. Furthermore, the torso-lift support 160 has a support plate 164 pivotally linked to the offset main beam 162 by a chest support lift mechanism 166. An arm support rod/plate 168 is connected to the support plate 164, and the second arm support 22B. The support plate 164 is attached to the chest support plate 100, and the chest support lift mechanism 166 includes various actuators 170A, 170B, and 170C used to facilitate positioning and repositioning of the support plate 164 (and hence, the chest support plate 100).

Figure 13B:
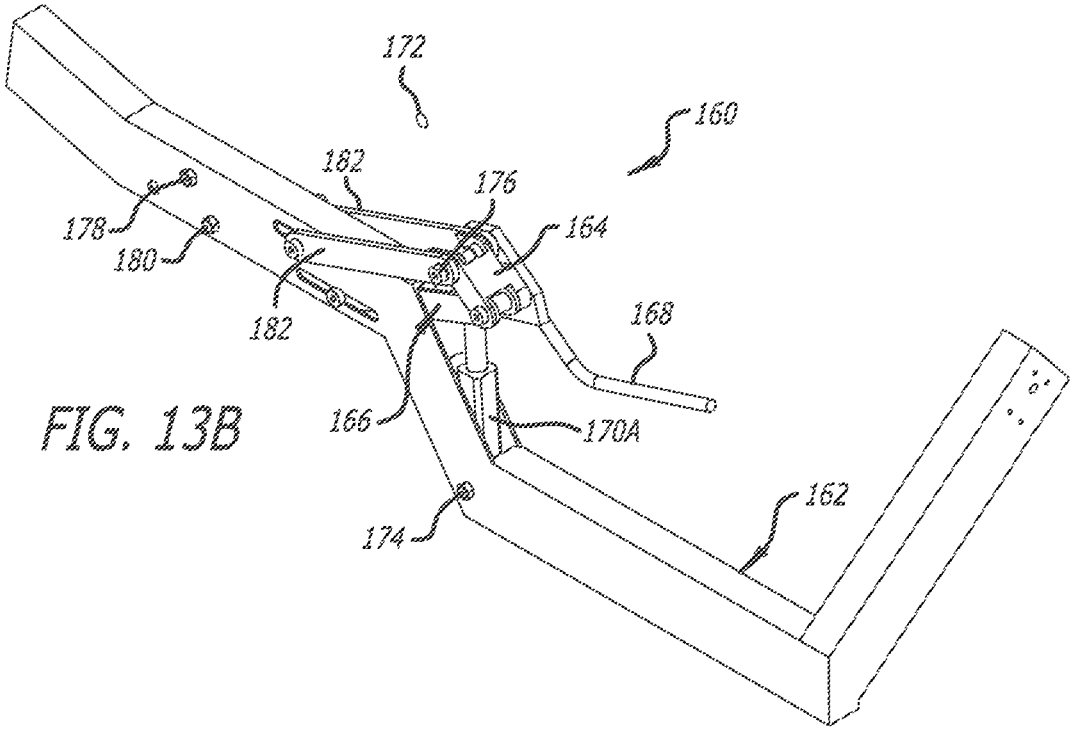
FIG. 13B is a perspective view similar to FIG. 13A showing the torso-lift support at half travel.
Figure 13C:
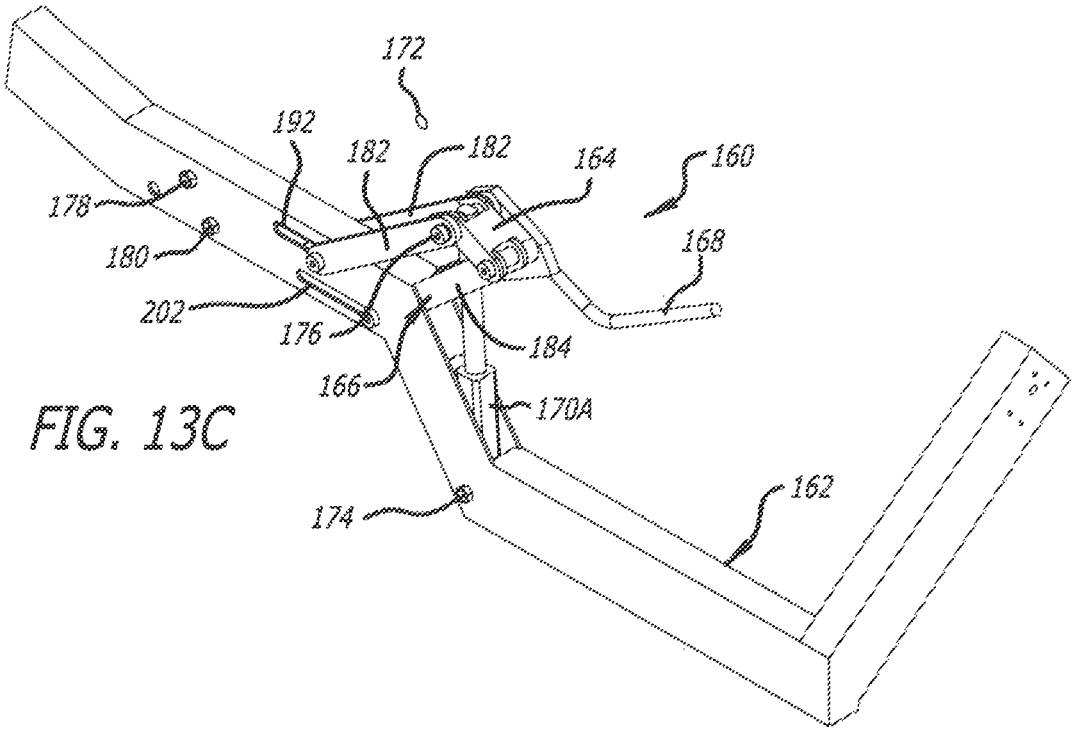
FIG. 13C is a perspective view similar to FIGS. 13A and 13B showing the torso-lift support at full travel.

As discussed below, the torso-lift support 160 depicted in FIGS. 13A-15 enables a COR 172 thereof to be programmably altered such that the COR 172 can be a fixed COR or a variable COR. As their names suggest, the fixed COR stays in the same position as the torso-lift support 160 is actuated, and the variable COR moves between a first position and a second position as the torso-lift support 160 is actuated between its initial position and final position at full travel thereof. Appropriate placement of the COR 172 is important so that spinal cord integrity is not compromised (i.e., overly compressed or stretched). Thus, the support plate 164 (and hence, the chest support plate 100) follows a path coinciding with a predetermined COR 172 (either fixed or variable). FIG. 13A depicts the torso-lift support 160 retracted, FIG. 13B depicts the torso-lift support 160 at half travel, and FIG. 13C depicts the torso-lift support 160 at full travel.

Figure 14:
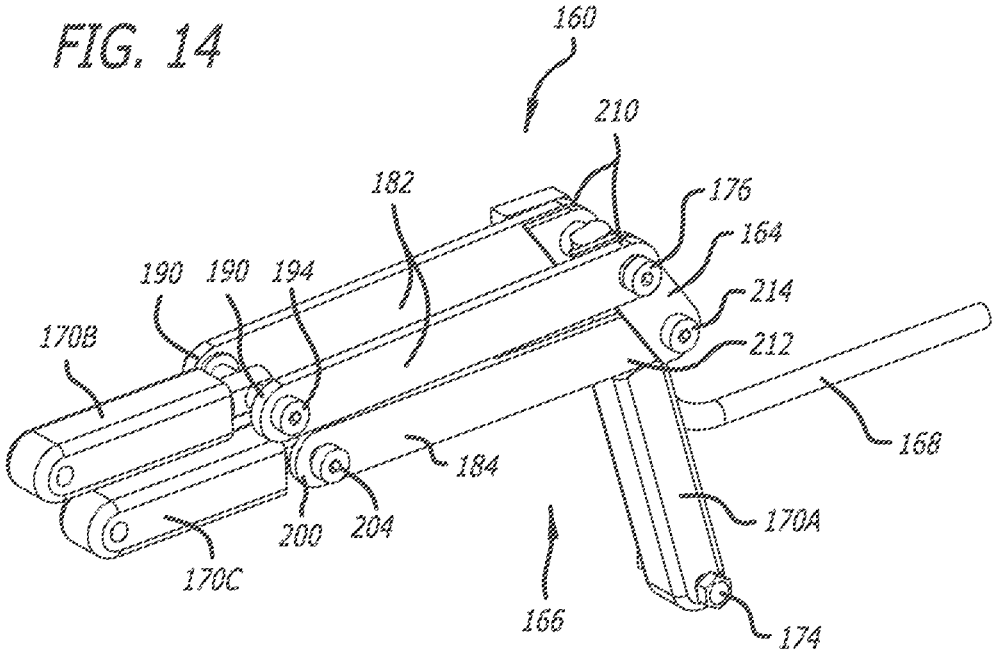
FIG. 14 is a perspective view of a chest support lift mechanism of the torso-lift support of FIGS. 13A-13C with actuators thereof retracted.
Figure 15:
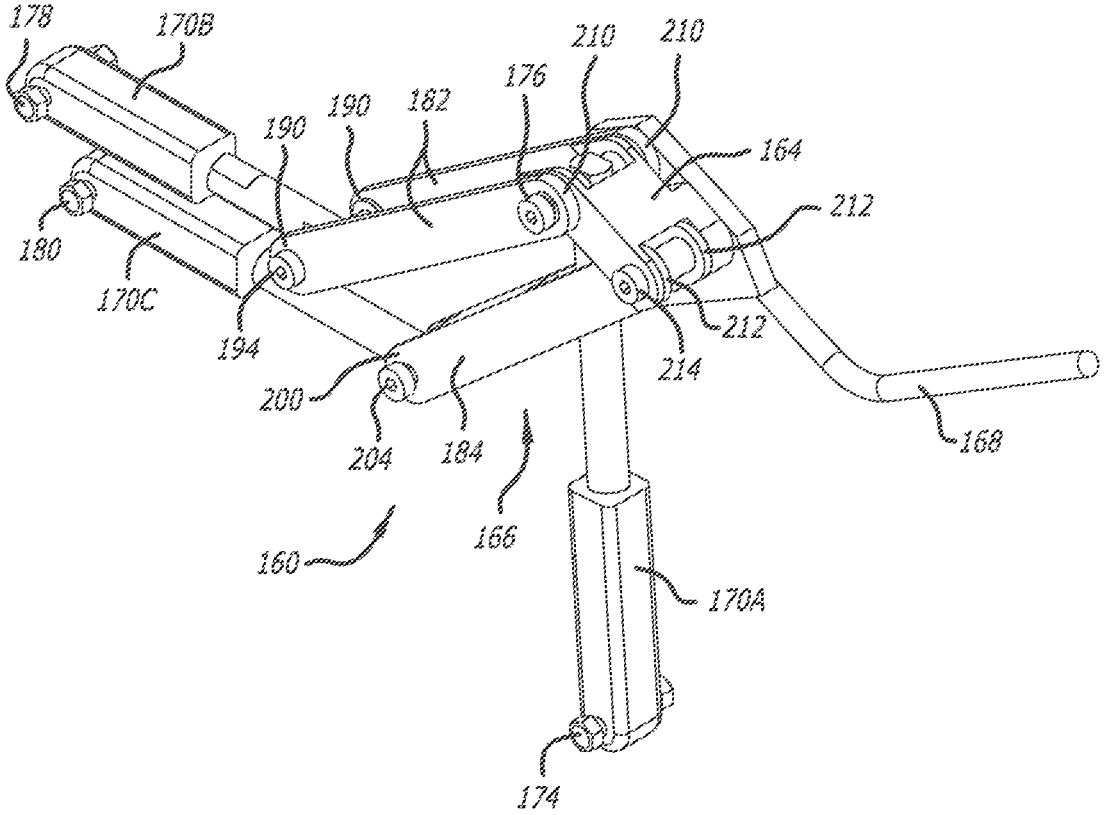
FIG. 15 is another perspective view of a chest support lift mechanism of the torso-lift support of FIGS. 13A-13C with the actuators thereof extended.

As discussed above, the chest support lift mechanism 166 includes the actuators 170A, 170B, and 170C to position and reposition the support plate 164 (and hence, the chest support plate 100). As depicted in FIGS. 14 and 15, for example, the first actuator 170A, the second actuator 170B, and the third actuator 170C are provided. Each of the actuators 170A, 170B, and 170C are interconnected with the offset main beam 12 and the support plate 164, and each of the actuators 170A, 170B, and 170C are moveable between a retracted and extended position. As depicted in FIGS. 13A-13C, the first actuator 170A is pinned to the offset main beam 162 using a pin 174 and pinned to the support plate 164 using a pin 176. Furthermore, the second and third actuators 170B and 170C are received within the offset main beam 162. The second actuator 170B is interconnected with the offset main beam 162 using a pin 178, and the third actuator 170C is interconnected with the offset main beam 162 using a pin 180.

The second actuator 170B is interconnected with the support plate 164 via first links 182, and the third actuator 170C is interconnected with the support plate 164 via second links 184. First ends 190 of the first links 182 are pinned to the second actuator 170B and elongated slots 192 formed in the offset main beam 162 using a pin 194, and first ends 200 of the second links 184 are pinned to the third actuator 170C and elongated slots 202 formed in the offset main beam 162 using a pin 204. The pins 194 and 204 are moveable within the elongated slots 192 and 202. Furthermore, second ends 210 of the first links 182 are pinned to the support plate 164 using the pin 176, and second ends 212 of the second links 184 are pinned to the support plate 164 using a pin 214. To limit interference therebetween, as depicted in FIGS. 13A-13C, the first links 182 are provided on the exterior of the offset main beam 162, and, depending on the position thereof, the second links 184 are positioned on the interior of the offset main beam 162.

Actuation of the actuators 170A, 1706, and 170C facilitates movement of the support plate 164. Furthermore, the amount of actuation of the actuators 170A, 1706, and 170C can be varied to affect different positions of the support plate 164. As such, by varying the amount of actuation of the actuators 170A, 1706, and 170C, the COR 172 thereof can be controlled. As discussed above, the COR 172 can be predetermined, and can be either fixed or varied. Furthermore, the actuation of the actuators 170A, 1706, and 170C can be computer controlled and/or operated by the operator of the surgical frame 10, such that the COR 172 can be programmed by the operator. As such, an algorithm can be used to determine the rates of extension of the actuators 170A, 1706, and 170C to control the COR 172, and the computer controls can handle implementation of the algorithm to provide the predetermined COR. A safety feature can be provided, enabling the operator to read and limit a lifting force applied by the actuators 170A, 1706, and 170C in order to prevent injury to the patient P. Moreover, the torso-lift support 160 can also include safety stops (not shown) to prevent over-extension or compression of the patient P, and sensors (not shown) programmed to send patient position feedback to the safety stops.

FIGS. 16-23 depict portions of the sagittal adjustment assembly 28. The sagittal adjustment assembly 28 can be used to distract or compress the patient's lumbar spine during or after lifting or lowering of the patient's torso by the torso-lift supports. The sagittal adjustment assembly 28 supports and manipulates the lower portion of the patient's body. In doing so, the sagittal adjustment assembly 28 is configured to make adjustments in the sagittal plane of the patient's body, including tilting the pelvis, controlling the position of the upper and lower legs, and lordosing the lumbar spine.

Figure 16:
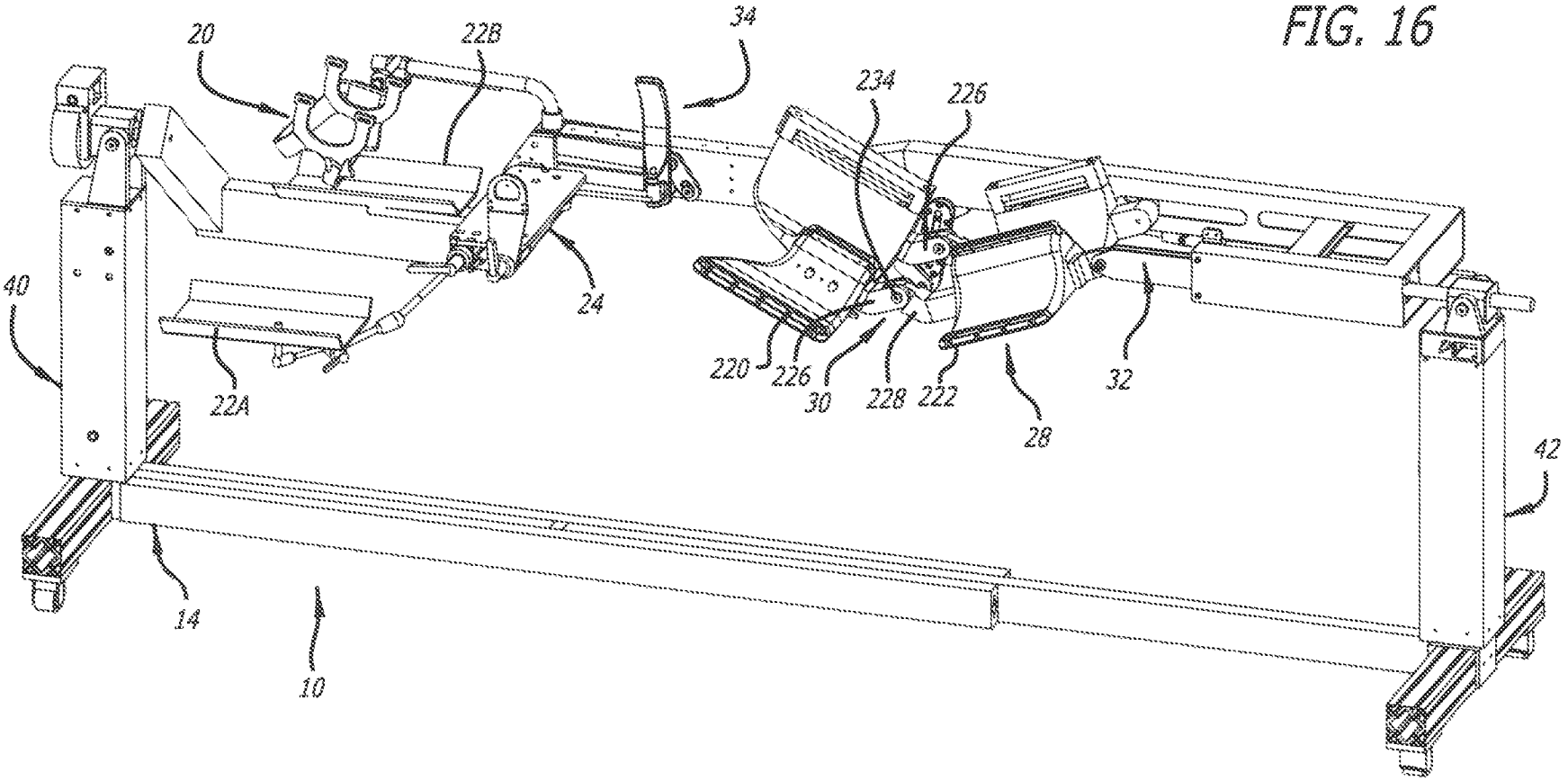
FIG. 16 is a top perspective view of the surgical frame of FIG. 5.
Figure 17:
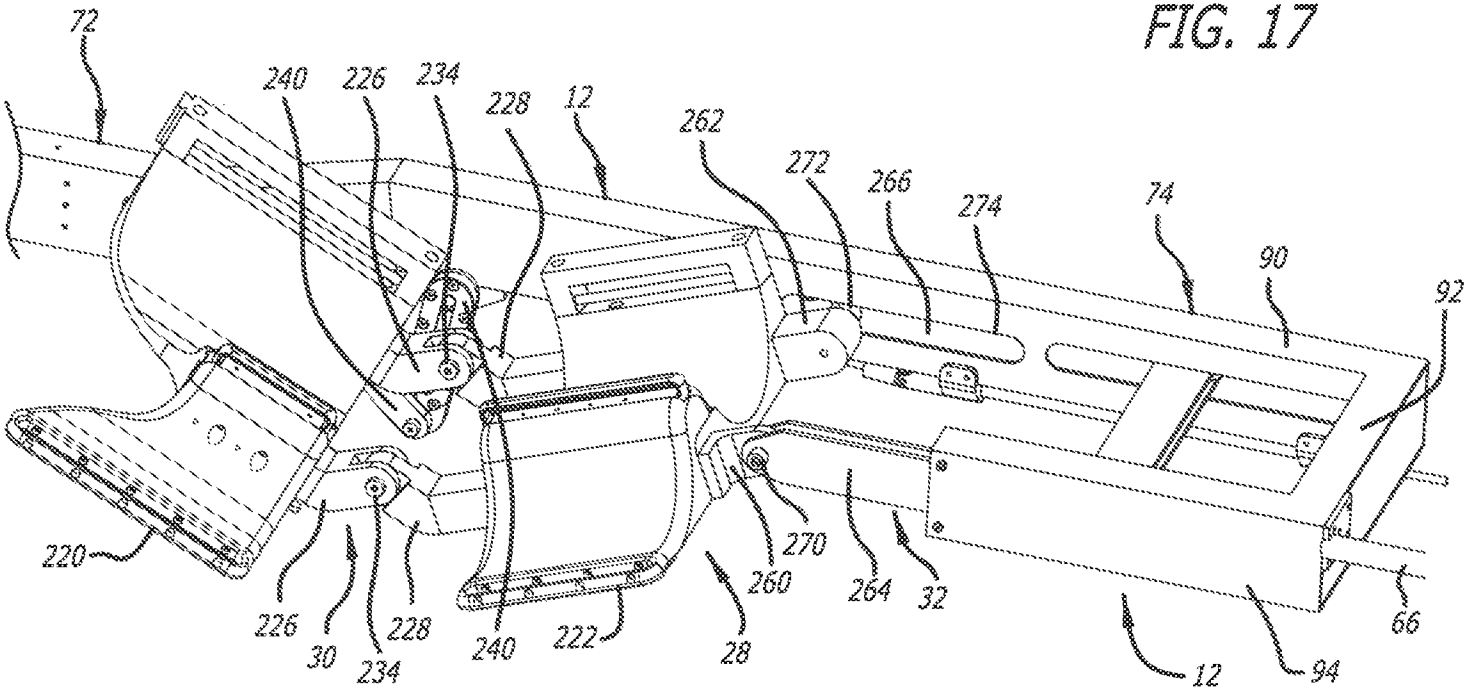
FIG. 17 is an enlarged top perspective view of portions of the surgical frame of FIG. 1 showing a sagittal adjustment assembly including a pelvic-tilt mechanism and leg adjustment mechanism.

As depicted in FIGS. 16 and 17, for example, the sagittal adjustment assembly 28 includes the pelvic-tilt mechanism 30 for supporting the thighs and lower legs of the patient P. The pelvic-tilt mechanism 30 includes a thigh cradle 220 configured to support the patient's thighs, and a lower leg cradle 222 configured to support the patient's shins. Different sizes of thigh and lower leg cradles can be used to accommodate different sizes of patients, i.e., smaller thigh and lower leg cradles can be used with smaller patients, and larger thigh and lower leg cradles can be used with larger patients. Soft straps (not shown) can be used to secure the patient P to the thigh cradle 220 and the lower leg cradle 222. The thigh cradle 220 and the lower leg cradle 222 are moveable and pivotal with respect to one another and to the offset main beam 12. To facilitate rotation of the patient's hips, the thigh cradle 220 and the lower leg cradle 222 can be positioned anterior and inferior to the patient's hips.

Figure 18:
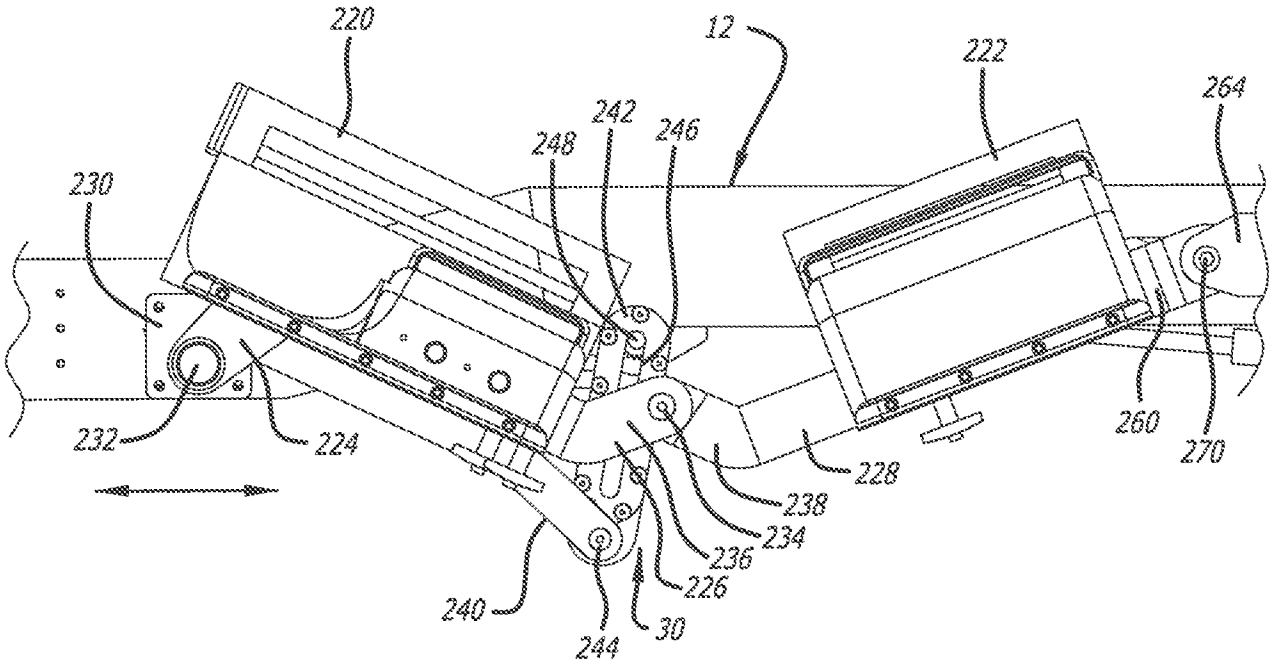
FIG. 18 is an enlarged side elevational view of portions of the surgical frame of FIG. 1 showing the pelvic-tilt mechanism.
Figure 25:
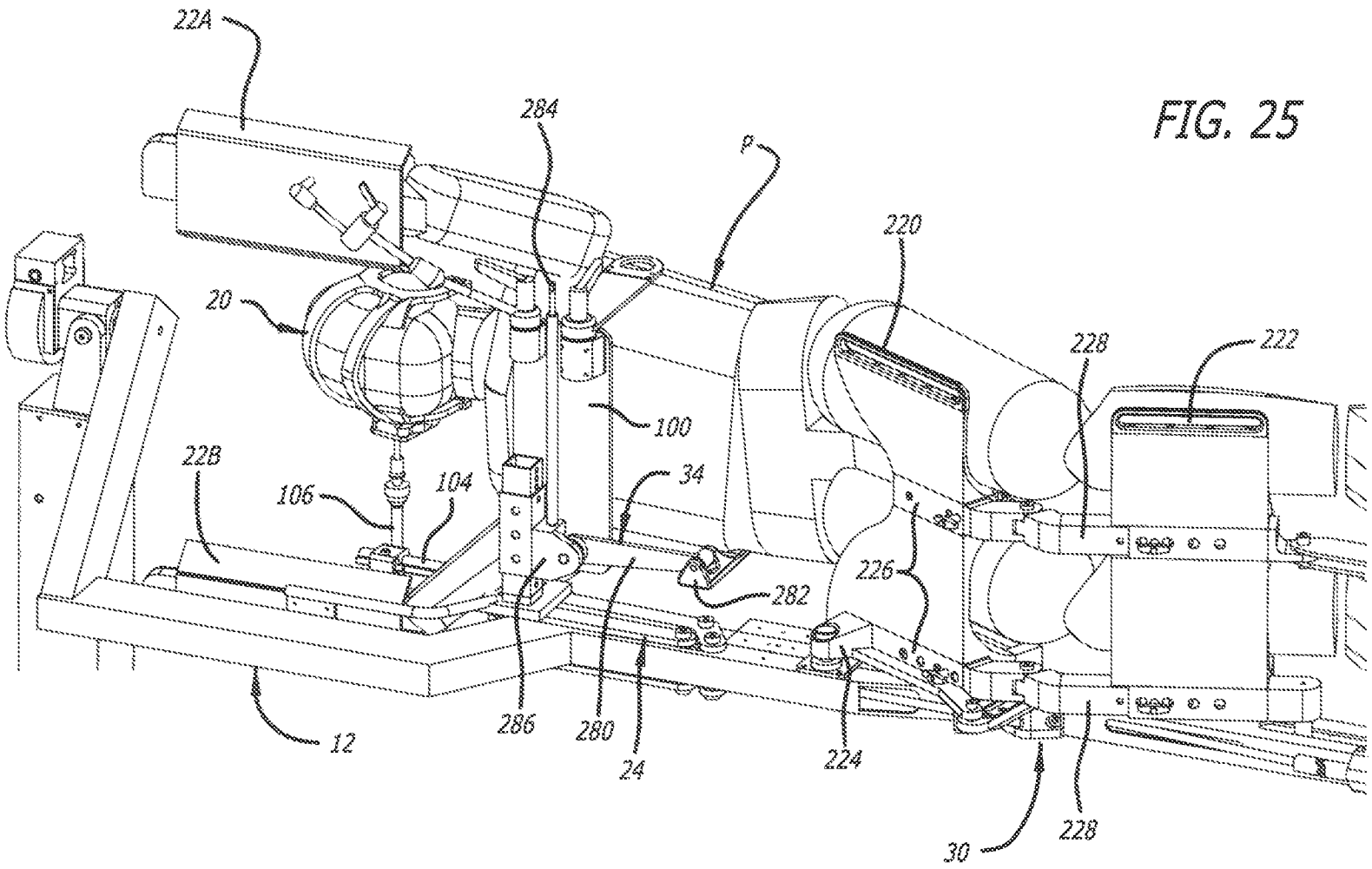
FIG. 25 is a top perspective view of portions of the surgical frame of FIG. 1 showing operation of the coronal adjustment assembly.

As depicted in FIGS. 18 and 25, for example, a first support strut 224 and second support struts 226 are attached to the thigh cradle 220. Furthermore, third support struts 228 are attached to the lower leg cradle 222. The first support strut 224 is pivotally attached to the offset main beam 12 via a support plate 230 and a pin 232, and the second support struts 226 are pivotally attached to the third support struts 228 via pins 234. The pins 234 extend through angled end portions 236 and 238 of the second and third support struts 226 and 228, respectively. Furthermore, the lengths of second and third support struts 226 and 228 are adjustable to facilitate expansion and contraction of the lengths thereof.

To accommodate patients with different torso lengths, the position of the thigh cradle 220 can be adjustable by moving the support plate 230 along the offset main beam 12. Furthermore, to accommodate patients with different thigh and lower leg lengths, the lengths of the second and third support struts 226 and 228 can be adjusted.

Figure 19:
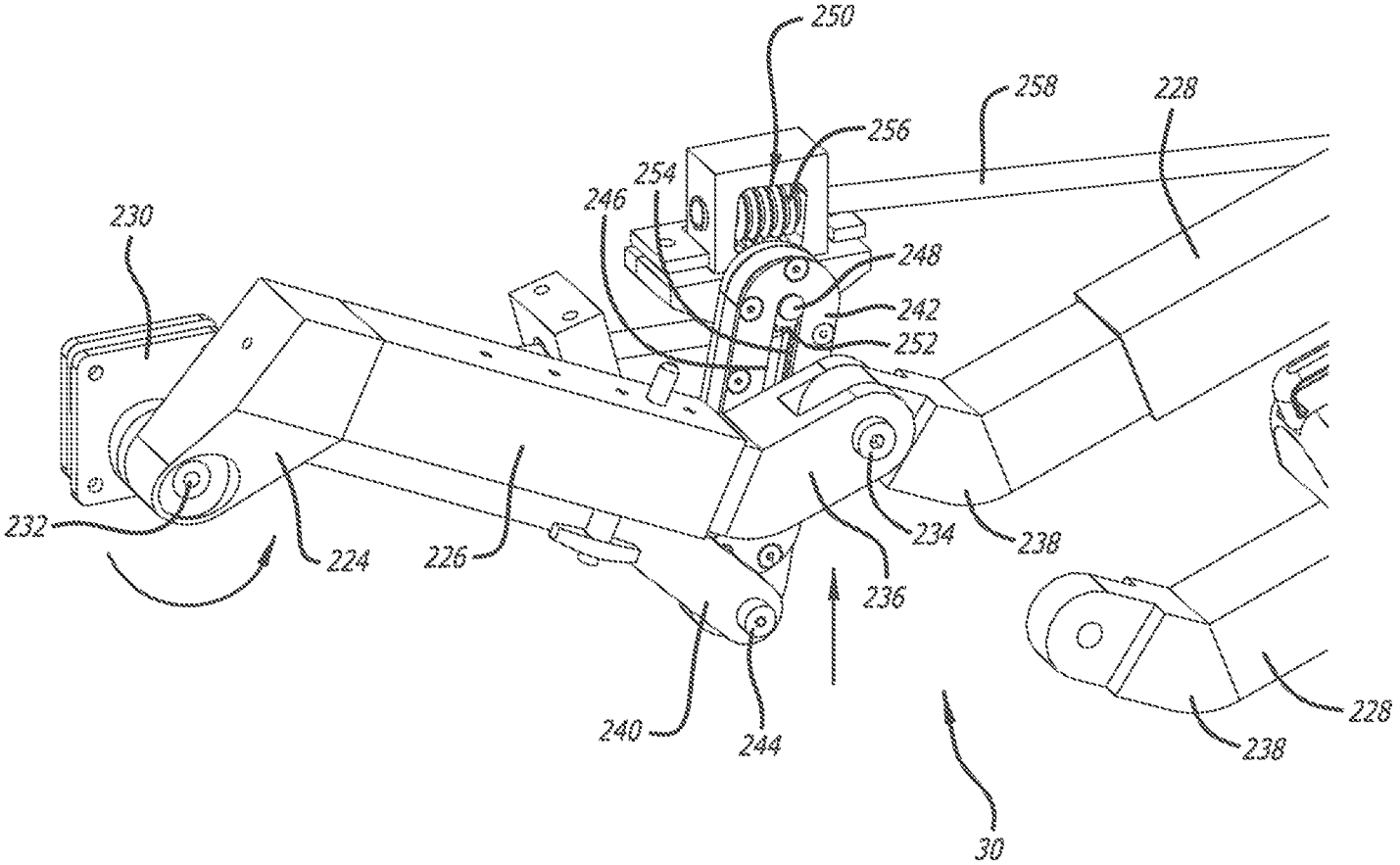
FIG. 19 is an enlarged perspective view of componentry of the pelvic-tilt mechanism.
Figure 20:
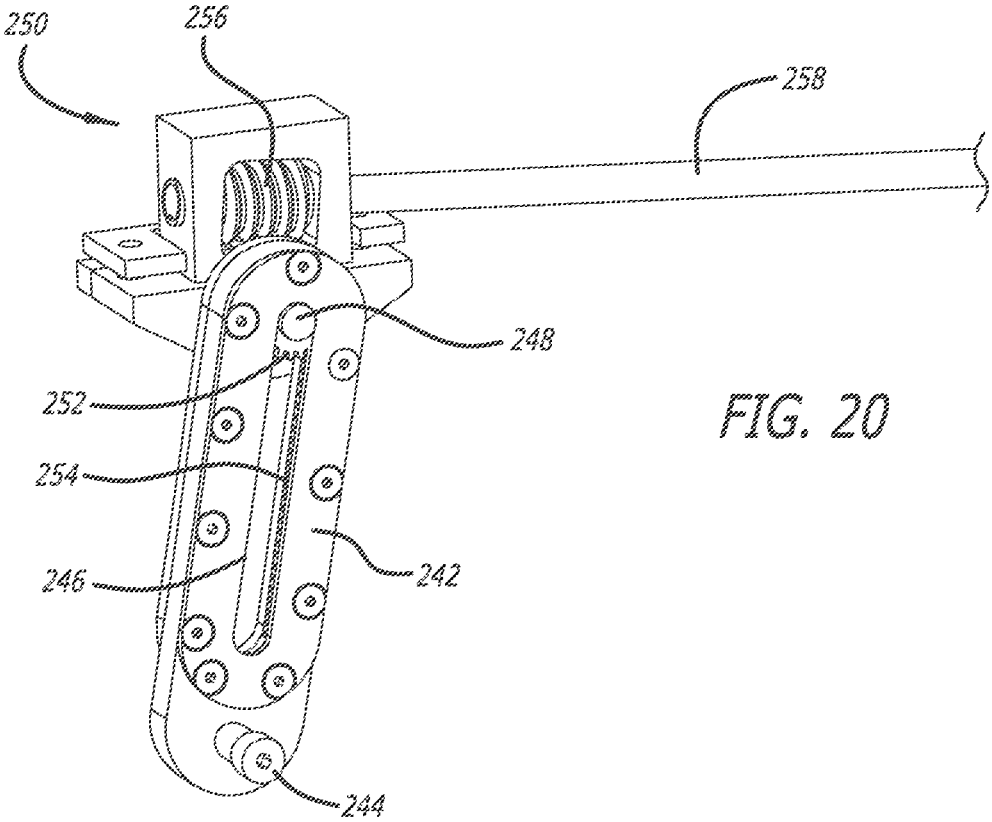
FIG. 20 is an enlarged perspective view of a captured rack and a worm gear assembly of the componentry of the pelvic-tilt mechanism.
Figure 21:
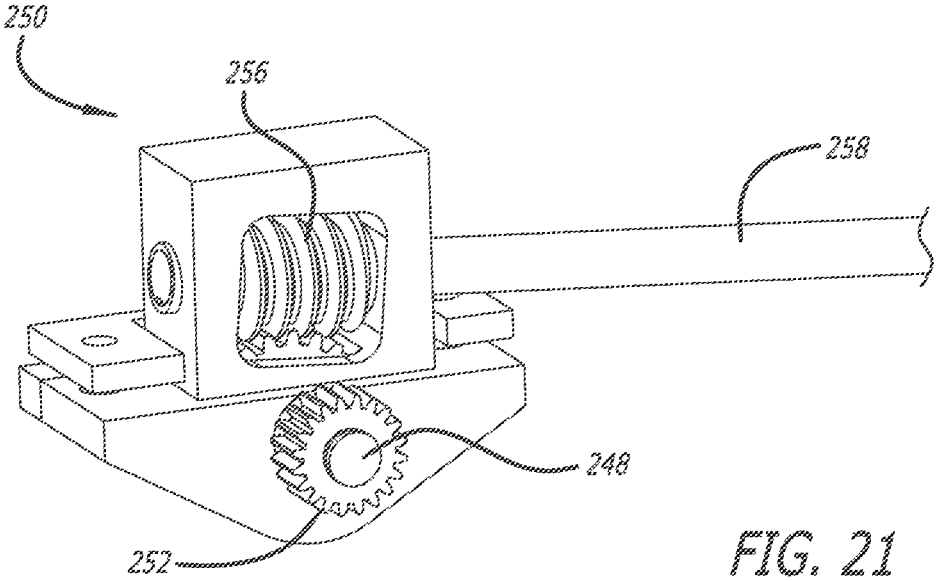
FIG. 21 is an enlarged perspective view of the worm gear assembly of FIG. 20.

To control the pivotal angle between the second and third support struts 226 and 228 (and hence, the pivotal angle between the thigh cradle 220 and lower leg cradle 222), a link 240 is pivotally connected to a captured rack 242 via a pin 244. The captured rack 242 includes an elongated slot 246, through which is inserted a worm gear shaft 248 of a worm gear assembly 250. The worm gear shaft 248 is attached to a gear 252 provided on the interior of the captured rack 242. The gear 252 contacts teeth 254 provided inside the captured rack 242, and rotation of the gear 252 (via contact with the teeth 254) causes motion of the captured rack 242 upwardly and downwardly. The worm gear assembly 250, as depicted in FIGS. 19-21, for example, includes worm gears 256 which engage a drive shaft 258, and which are connected to the worm gear shaft 248.

The worm gear assembly 250 also is configured to function as a brake, which prevents unintentional movement of the sagittal adjustment assembly 28. Rotation of the drive shaft 258 causes rotation of the worm gears 256, thereby causing reciprocal vertical motion of the captured rack 242. The vertical reciprocal motion of the captured rack 242 causes corresponding motion of the link 240, which in turn pivots the second and third support struts 226 and 228 to correspondingly pivot the thigh cradle 220 and lower leg cradle 222. A servomotor (not shown) interconnected with the drive shaft 258 can be computer controlled and/or operated by the operator of the surgical frame 10 to facilitate controlled reciprocal motion of the captured rack 242.

The sagittal adjustment assembly 28 also includes the leg adjustment mechanism 32 facilitating articulation of the thigh cradle 220 and the lower leg cradle 222 with respect to one another. In doing so, the leg adjustment mechanism 32 accommodates the lengthening and shortening of the patient's legs during bending thereof. As depicted in FIG. 17, for example, the leg adjustment mechanism 32 includes a first bracket 260 and a second bracket 262 attached to the lower leg cradle 222. The first bracket 260 is attached to a first carriage portion 264, and the second bracket 262 is attached to a second carriage portion 266 via pins 270 and 272, respectively. The first carriage portion 264 is slidable within third portion 94 of the rear portion 74 of the offset main beam 12, and the second carriage portion 266 is slidable within the first portion 90 of the rear portion 74 of the offset main beam 12. An elongated slot 274 is provided in the first portion 90 to facilitate engagement of the second bracket 262 and the second carriage portion 266 via the pin 272. As the thigh cradle 220 and the lower leg cradle 222 articulate with respect to one another (and the patient's legs bend accordingly), the first carriage 264 and the second carriage 266 can move accordingly to accommodate such movement.

Figure 22:
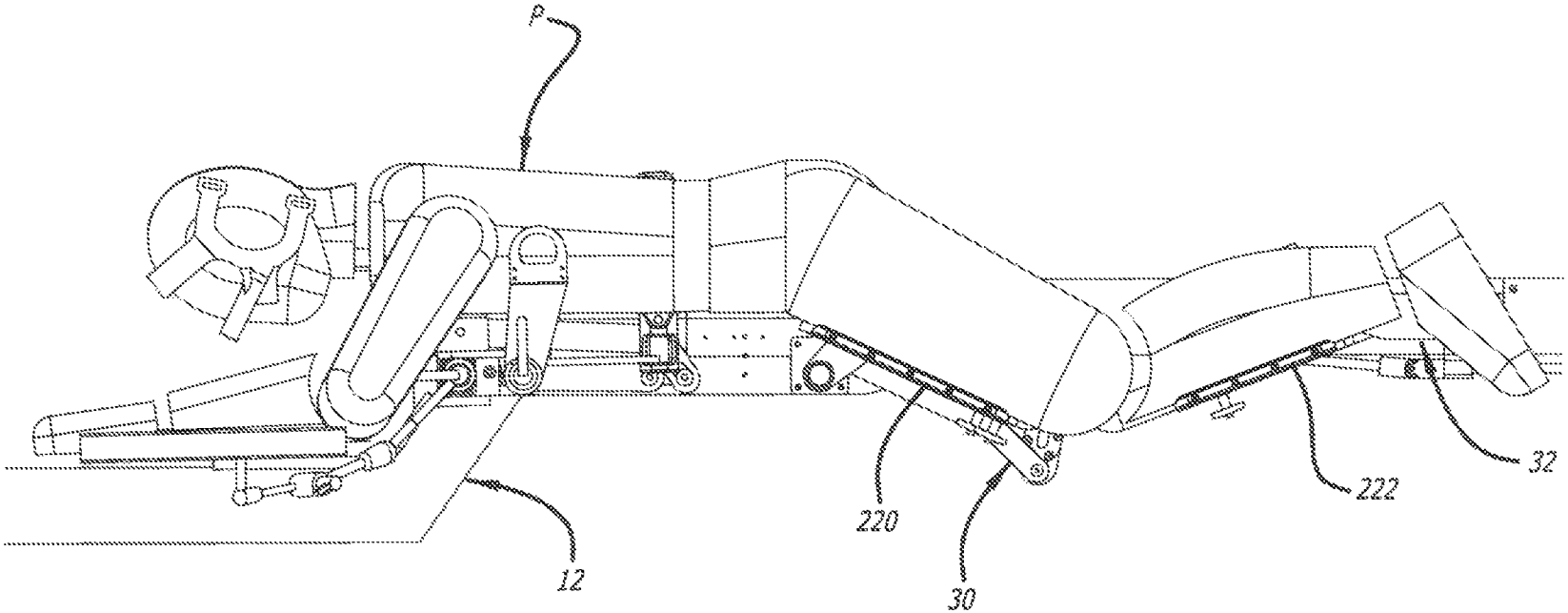
FIG. 22 is a side elevational view of portions of the surgical frame of FIG. 1 showing the patient positioned thereon and the pelvic-tilt mechanism of the sagittal adjustment assembly in the flexed position.
Figure 23:
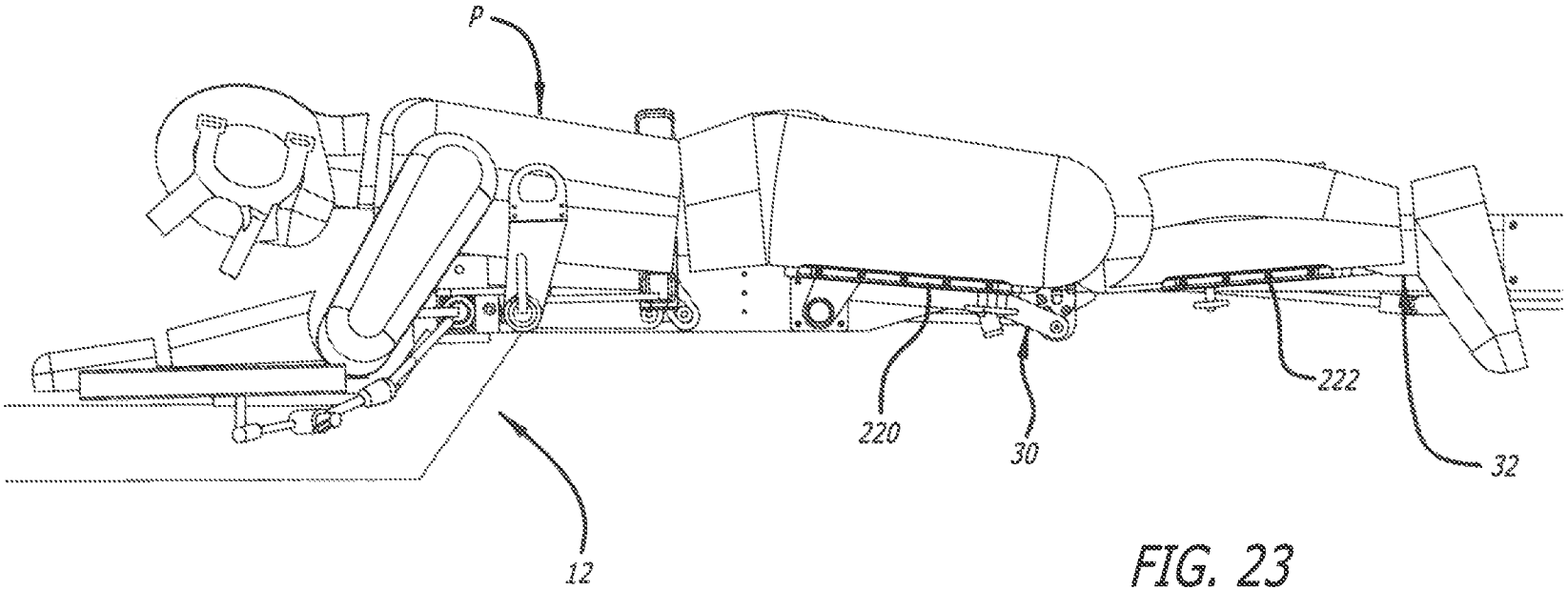
FIG. 23 is another side elevational view of portions of the surgical frame of FIG. 1 showing the patient positioned thereon and the pelvic-tilt mechanism of the sagittal adjustment assembly in the fully extended position.

The pelvic-tilt mechanism 30 is movable between a flexed position and a fully extended position. As depicted in FIG. 22, in the flexed position, the lumbar spine is hypo-lordosed. This opens the posterior boundaries of the lumbar vertebral bodies and allows for easier placement of any interbody devices. The lumbar spine stretches slightly in this position. As depicted in FIG. 23, in the extended position, the lumbar spine is lordosed. This compresses the lumbar spine. When posterior fixation devices, such as rods and screws, are placed, optimal sagittal alignment can be achieved. During sagittal alignment, little to negligible angle change occurs between the thighs and the pelvis. The pelvic-tilt mechanism 30 also can hyper-extend the hips as a means of lordosing the spine, in addition to tilting the pelvis. One of ordinary skill will recognize, however, that straightening the patient's legs does not lordose the spine. Leg straightening is a consequence of rotating the pelvis while maintaining a fixed angle between the pelvis and the thighs.

The sagittal adjustment assembly 28, having the configuration described above, further includes an ability to compress and distract the spine dynamically while in the lordosed or flexed positions. The sagittal adjustment assembly 28 also includes safety stops (not shown) to prevent over-extension or compression of the patient, and sensors (not shown) programmed to send patient position feedback to the safety stops.

Figure 24:
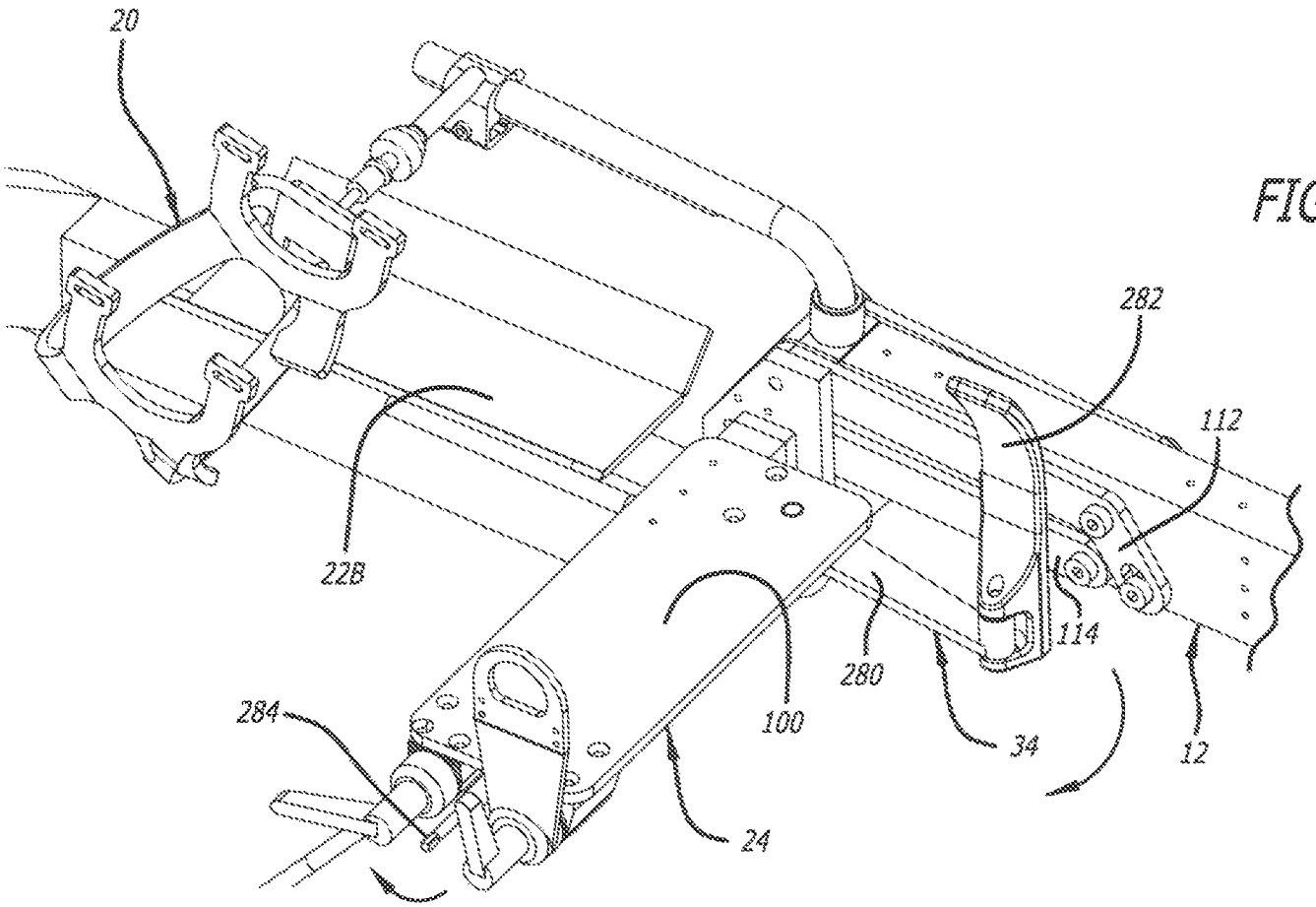
FIG. 24 is an enlarged top perspective view of portions of the surgical frame of FIG. 1 showing a coronal adjustment assembly.
Figure 26:
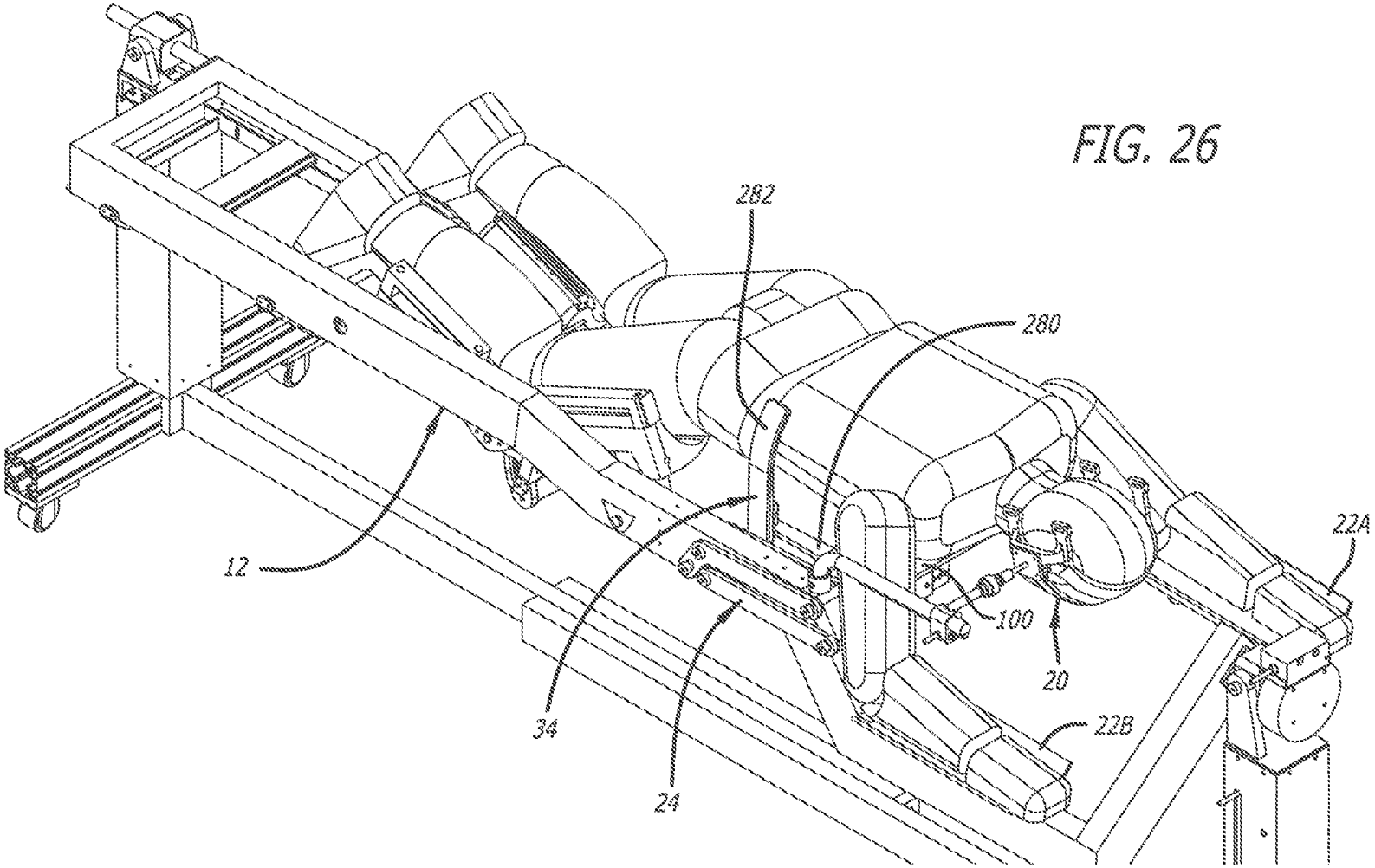
FIG. 26 is a top perspective view of a portion of the surgical frame of FIG. 1 showing operation of the coronal adjustment assembly.

As depicted in FIGS. 24-26, for example, the coronal adjustment assembly 34 is configured to support and manipulate the patient's torso, and further to correct a spinal deformity, including but not limited to a scoliotic spine. As depicted in FIGS. 24-26, for example, the coronal adjustment assembly 34 includes a lever 280 linked to an arcuate radio-lucent paddle 282. As depicted in FIGS. 24 and 25, for example, a rotatable shaft 284 is linked to the lever 280 via a transmission 286, and the rotatable shaft 284 projects from an end of the chest support plate 100. Rotation of the rotatable shaft 284 is translated by the transmission 286 into rotation of the lever 280, causing the paddle 282, which is linked to the lever 280, to swing in an arc. Furthermore, a servomotor (not shown) interconnected with the rotatable shaft 284 can be computer controlled and/or operated by the operator of the surgical frame 10 to facilitate controlled rotation of the lever 280.

As depicted in FIG. 24, for example, adjustments can be made to the position of the paddle 282 to manipulate the torso and straighten the spine. As depicted in FIG. 25, when the offset main beam 12 is positioned such that the patient P is positioned in a lateral position, the coronal adjustment assembly 34 supports the patient's torso. As further depicted in FIG. 26, when the offset main beam 12 is positioned such that the patient P is positioned in a prone position, the coronal adjustment assembly 34 can move the torso laterally, to correct a deformity, including but not limited to a scoliotic spine. When the patient is strapped in via straps (not shown) at the chest and legs, the torso is relatively free to move and can be manipulated. Initially, the paddle 282 is moved by the lever 280 away from the offset main beam 12. After the paddle 282 has been moved away from the offset main beam 12, the torso can be pulled with a strap towards the offset main beam 12. The coronal adjustment assembly 34 also includes safety stops (not shown) to prevent over-extension or compression of the patient, and sensors (not shown) programmed to send patient position feedback to the safety stops.

Portions of a preferred embodiment of a surgical frame are generally indicated by the numeral 300 in FIGS. 27-32. The surgical frame 300 serves as an exoskeleton to support the body of the patient P as the patient's body is manipulated thereby. In doing so, the surgical frame 300 serves to support the patient P such that the patient's spine does not experience unnecessary stress/torsion.

The surgical frame 300 is similar to the surgical frame 10, and thus, the surgical frame 300 contains features similar to those of the surgical frame 10. Like the surgical frame 10, the surgical frame 300 can include the offset main beam 12. Although not shown, the surgical frame 300, like the surgical frame 10, can include the head support 20, the arm supports 22, the pelvic-tilt mechanism 30, and the leg adjustment mechanism 32. However, rather than relying solely on either of the torso-lift supports 24 and 26, the surgical frame 300 includes a torso-sling support generally indicated by the numeral 302.

The torso-sling support 302 is used in supporting the patient's torso on the surgical frame 300. As discussed below, the torso-sling support 302 affords access to the posterior side, specifically, the posterior torso (or back) of the patient P. In doing so, the torso-sling support 302 serves in effectively hanging the patient's torso on the surgical frame 300, when the patient P is in the lateral position (FIGS. 27-32). The torso-sling support 302 can be used by itself or in conjunction with either of the torso-lift supports 24 and 26 to support the patient P with respect to the surgical frame 300.

As depicted in FIGS. 27-32, the torso-sling support 302 includes a support frame 304, support straps 306, and a bracket and ring portion 308. As discussed below, the support frame 304 includes portions for contacting and supporting the lateral sides, shoulders, and neck on the posterior side of the patient P, and the support straps 306 include portions for contact and supporting a lateral side and a shoulder of the patient P. As depicted in FIGS. 27-32, the support straps 306 contact and support the right lateral side and the right shoulder of the patient P. Furthermore, the bracket and ring portion 308 facilitates attachment of portions of the support straps 306 thereto. As discussed below, the bracket and ring portion 308 serves to attach the torso-sling support 302 to the remainder of the surgical frame 300.

To facilitate use of the torso-sling support 302, the patient P is first supported by the surgical frame 300 in a prone position, and thereafter, the torso-sling support 302 is attached to the patient P. The surgical frame 300 includes a chest support plate 310 and optional chest support pads 311 for supporting the chest of the patient P thereon. The chest support plate 310 is used in supporting the patient P in the prone position on the surgical frame 300, and the chest support pads 311 can be positioned between the surgical frame 300 and the patient P. Besides using the chest support pads 311 to cushion the patient P on the chest support plate 310, various thicknesses of chest support pads 311 can be used to alter the distance between the chest support plate 310 and the patient P. To illustrate, thinner chest support pads 311 can be used when it is desirous to have the patient P positioned closer to the chest support plate 310, and thicker chest support pads 311 can be used when it is desirous to have the patient P positioned farther away from the chest support plate 310.

The chest support plate 310 can be part of either of the torso-lift supports 24 and 26, when either of the torso-lift supports are used with the surgical frame. Otherwise, the chest support plate 310 can be attached directly to the remainder of the surgical frame 300. To that end, the chest support plate 310 is attached to the offset main beam 12 by a support post 312 and support collar 314. The support post 312 can be attached to the offset main beam 12, and the support collar 314 can be attached at or adjacent an end of the chest support plate 310. The support collar 314 is sized to receive a portion of the support post 312 therein, and movement of the support collar 314 with respect to the support post 312 serves in positioning and repositioning the chest support plate 310. To facilitate fixation of the position of the support collar 314 relative to the support post 312, a pin 316, apertures 318 through opposed sides of the support collar 314, and sets of apertures (not shown) through opposed sides of the support post 312 are provided. When the apertures 318 are aligned with one of the sets of apertures 320, insertion of one of the pin 316 through the apertures 318 and one of the sets of apertures 320 serves to hold the support collar 314 in position relative to the support post 312, and fix the chest support plate 310 in position.

Figure 28:
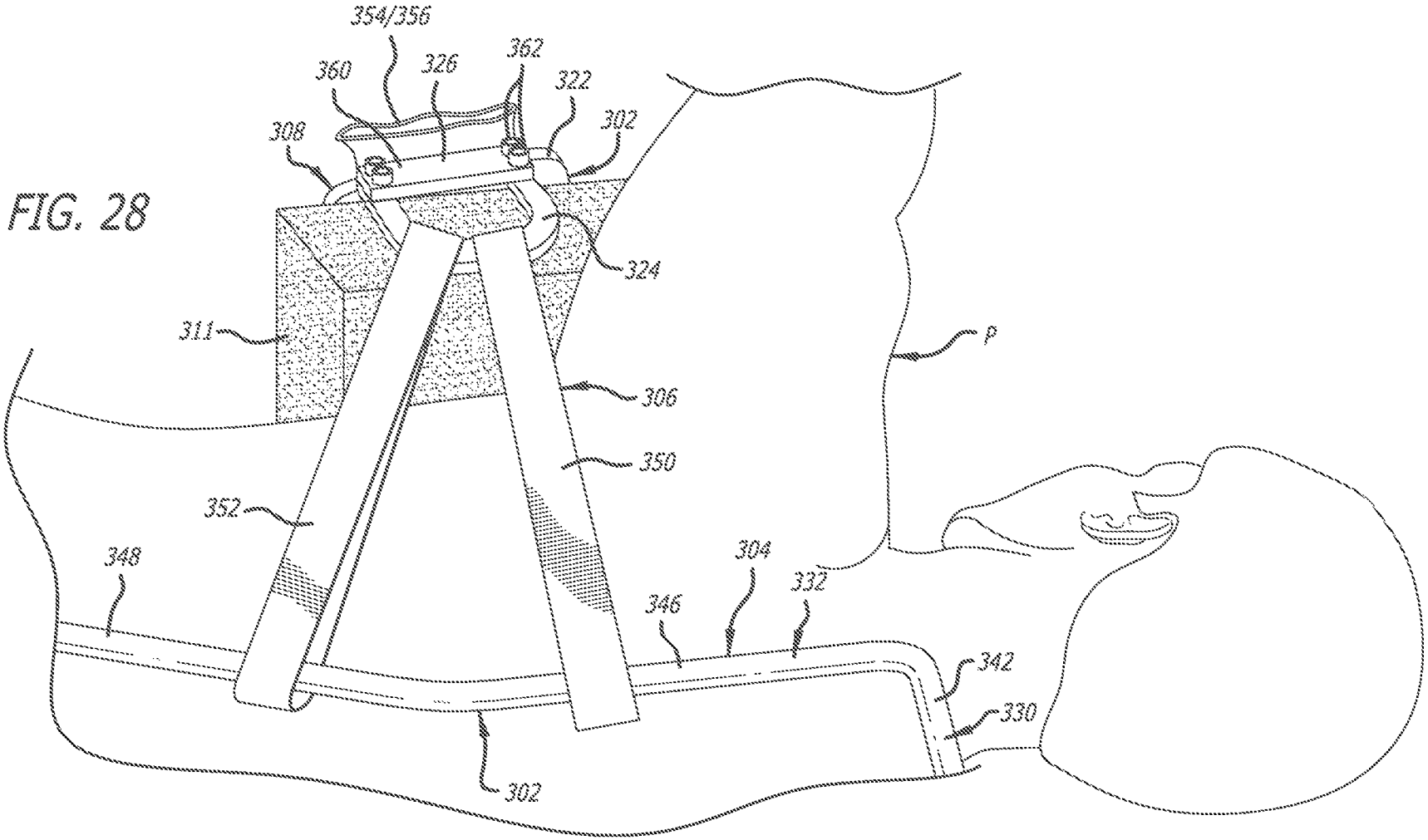
FIG. 28 is a top perspective view of a portion of the upper torso, the left shoulder, the head, and the upper left arm from the posterior side of the patient and a portion of the torso-sling supporting the patient in the lateral position with respect to the surgical frame.
Figure 32:
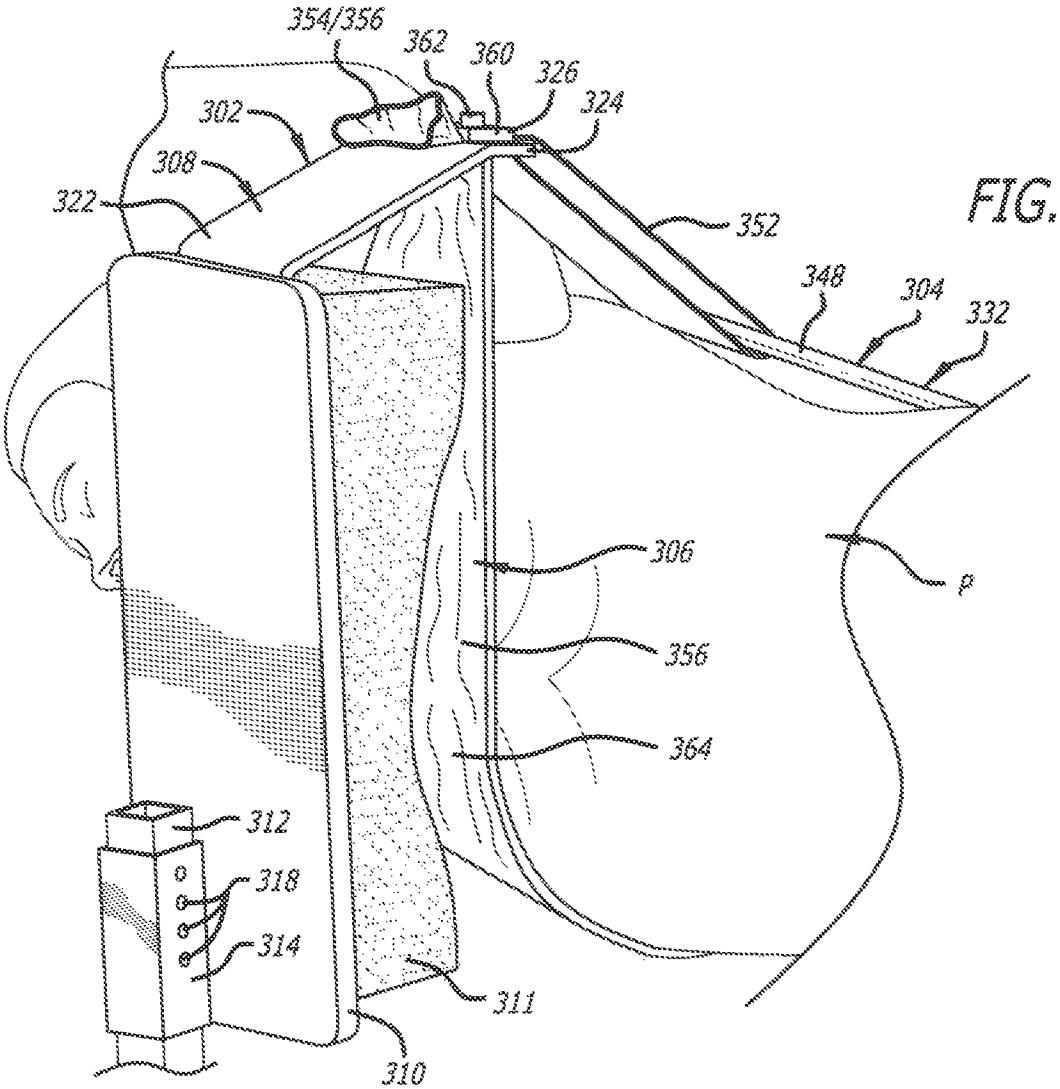
FIG. 32 is a side elevational view of the torso and a portion of the head of the patient from the anterior side of the patient and a portion of the torso-sling supporting the patient in the lateral position with respect to the surgical frame.

The bracket and ring portion 308 can be attached at or adjacent an end of the chest support plate 310 opposite from the support collar 314. The bracket and ring portion 308 includes a bracket portion 322, a ring portion 324, and a clamp portion 326. As depicted in FIGS. 28 and 32, the bracket portion 322 is attached to the chest support plate 310, and the ring portion 324 extends outwardly from the bracket portion 322. The ring portion 324 and clamp portion 326 serve as points of attachment for the support straps 306.

Figure 27:
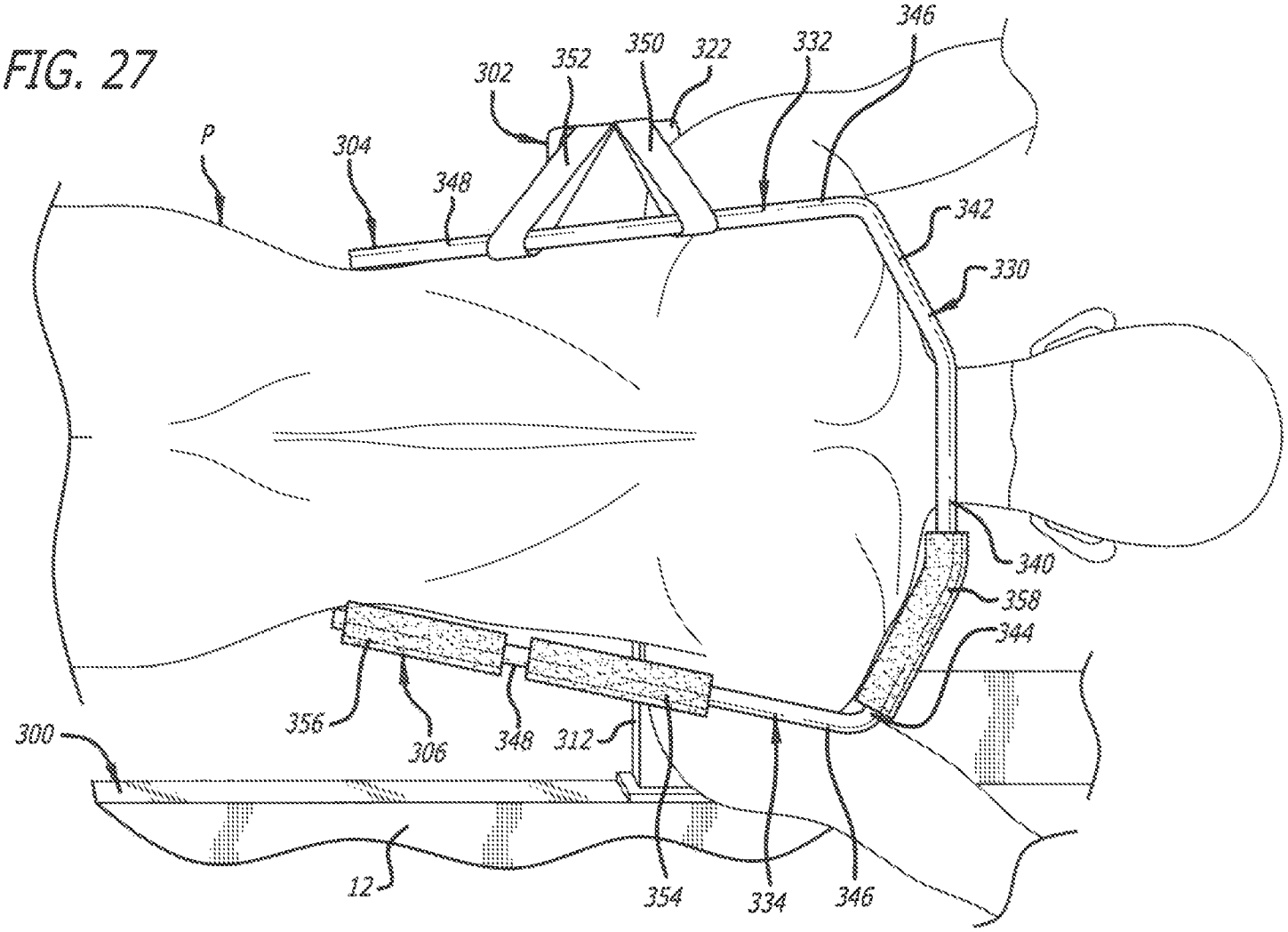
FIG. 27 is a side elevational view of a portion of the posterior side of a patient and a portion of a torso-sling in accordance with an embodiment of the present invention supporting the patient in a lateral position with respect to a surgical frame.

The support frame 304 includes a transition portion 330, a first side portion 332 extending from the transition portion 330, and a second side portion 334 extending from the transition portion 330. Generally, the transition portion 330, the first side portion 332, and the second side portion 334 form a U-shape. As depicted in FIG. 27, the transition portion 330 is positionable adjacent the neck and the shoulders on the posterior side of the patient P, the first side portion 332 extends from the left shoulder of the patient P along the left lateral side of the patient's back to the patient's left hip, and the second side portion 334 extends from the right shoulder of the patient P along the right lateral side of the patient's back to the patient's right hip. In doing so, the support frame 304 provides access to a substantial portion of the posterior torso (or back) of the patient P.

The transition portion 330 includes a central member 340, a first member 342, and a second member 344. As depicted in FIG. 27, the central member 340 is positioned adjacent the patient's neck on the posterior side of the patient P, the first member 342 is positioned adjacent the patient's left shoulder on the posterior side of the patient P, and the second member 344 is positioned adjacent the patient's right shoulder on the posterior side of the patient P. The angle between the central member 340 and the first member 342 and the angle between the central member 340 and the second member 344 can be configured to accommodate the anatomy of the patient's neck and shoulders. Furthermore, the first and second side portions 332 and 334 each include a third member 346 and a fourth member 348. The angles between each of the third members 346 and the fourth members 348 can also be configured to accommodate the anatomy of the left and right lateral sides of the patient's back.

The support straps 306 are used in conjunction with the bracket and ring portion 308 and the support frame 304 to hang the patient's torso on the surgical frame 300. A first support strap 350 and a second support strap 352 extend from the bracket and ring portion 308 to the first side portion 332. In doing so, the first and second support straps 350 and 352, as depicted in FIGS. 27 and 28, pass adjacent the left lateral side of the patient P. More specifically, the first support strap 350 extends from the ring portion 324 to the third member 346 of the first side portion 332, and the second support strap 352 extends from the ring portion 324 to the fourth member 348 of the first side portion 332.

Figure 29:
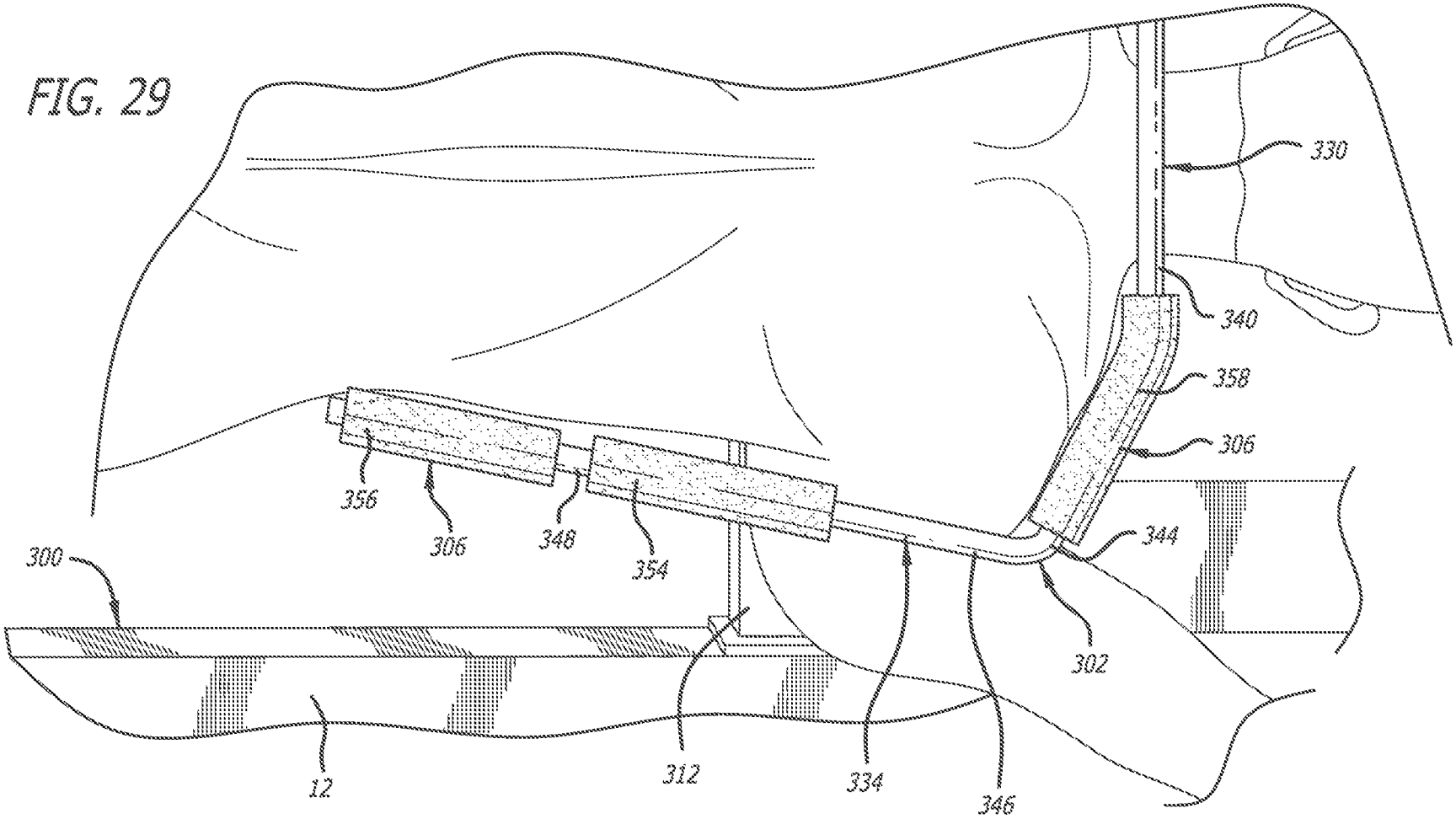
FIG. 29 is a side elevational view of a portion of the torso, the right shoulder, a portion of the head, and the upper right arm from the posterior side of the patient and a portion of the torso-sling supporting the patient in the lateral position with respect to the surgical frame.
Figure 30:
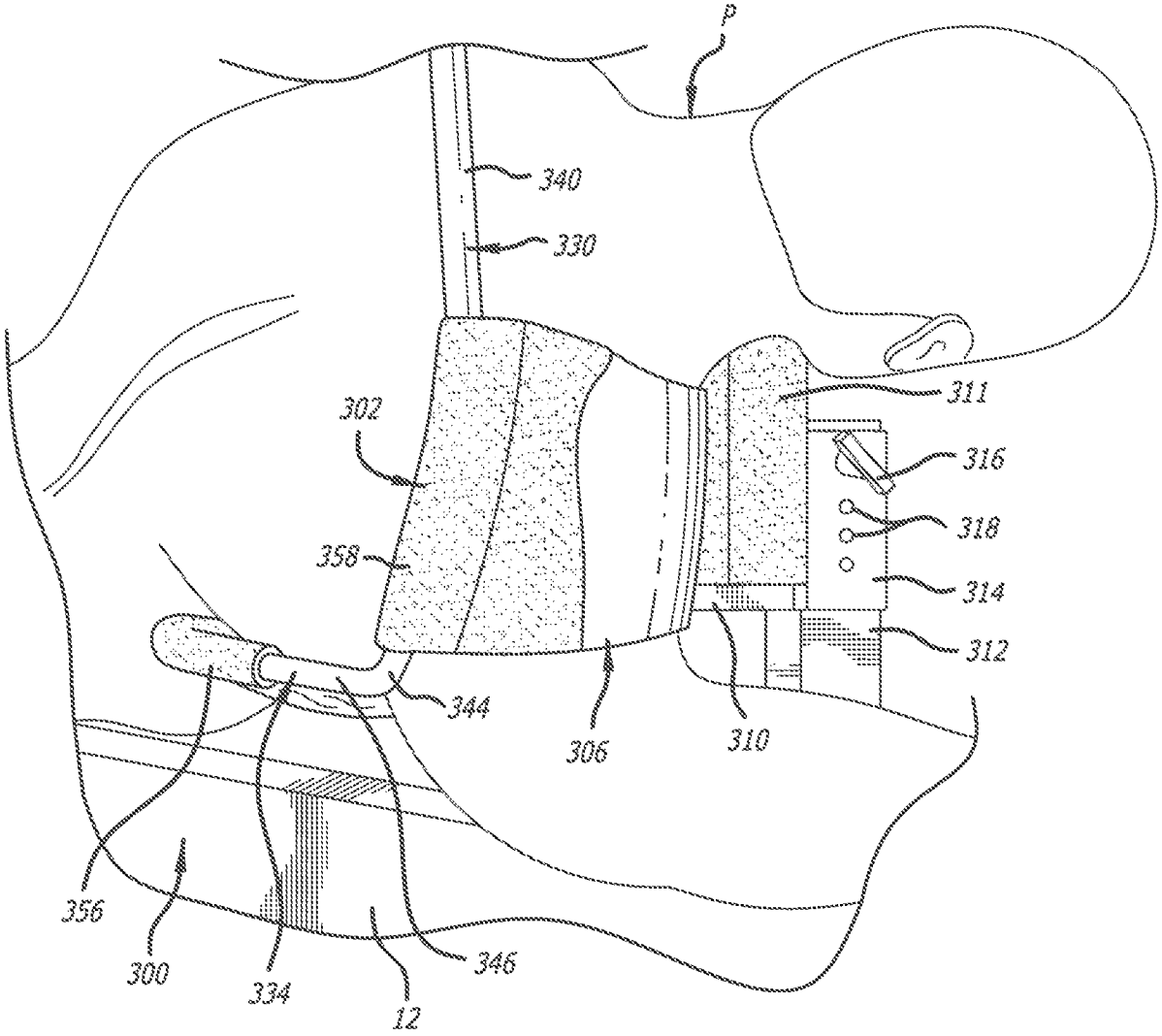
FIG. 30 is a side elevational view of a portion of the upper torso, the right shoulder, the head, and the upper right arm from the posterior side of the patient and a portion of the torso-sling supporting the patient in the lateral position with respect to the surgical frame.

Additionally, a third support strap 354 and a fourth support strap 356 extend from the bracket and ring portion 308 to the second side portion 334. In doing so, the third and fourth support straps 354 and 356, as depicted in FIGS. 29, 30, and 32, pass adjacent the patient's anterior torso and right lateral side. More specifically, the third support strap 354 extends from the clamp portion 326 adjacent the ring portion 324, and contacts the patient's upper anterior torso and right lateral side as it extends to the third member 346 of the second side portion 334; and the fourth support strap 356 extends from the clamp portion 326 adjacent the ring portion 324, and contacts the patient's lower anterior torso and right lateral side as it extends to the fourth member 348 of the second side portion 334. In contacting the patient P, the third and fourth support straps 354 and 356 serve to cradle the portions of the patient's right lateral side and torso (including the patient's chest and stomach).

To facilitate attachment thereto, the first, second, third, and fourth support straps 350, 352, 354, and 356 can include portions formed as loops that can be received on the support frame 304 and/or the bracket and ring portion 308. For example, the first support strap 350 can be looped around the third member 346 of the first side portion 332 and can be looped around the ring portion 324, and the second support strap 352 can be looped around the fourth member 348 of the first side portion 332, and can be looped around the ring portion 324. Furthermore, the third support strap 354 can be attached to the bracket and ring portion 308 by the clamp portion 326, and can be looped around the third member 346 of the second side portion 334, and the fourth support strap 356 can be attached to the bracket and ring portion 308 by the clamp portion 326, and can be looped around the fourth member 348 of the second side portion 334.

The loops formed by the first, second, third, and fourth support straps 350, 352, 354, and 356 should be strong enough to hold at least a portion of the weight of the patient P. As such, the loops formed by the first, second, third, and fourth support straps 350, 352, 354, and 356 can be fixed or formed by connections such as Velcro, buckles, buttons, clasps, catches, or other fastening mechanisms.

To facilitate attachment of the third and fourth support straps 354 and 356 to the bracket and ring portion 308, end portions of the third and fourth support straps 354 and 356 are inserted through the ring portion 324, and the clamp portion 326 is then used to clamp these end portions to the bracket and ring portion 308. As depicted in FIGS. 28 and 32, the clamp portion 326 includes a clasp 360 and fasteners 362 that are used to clamp the ends of the third and fourth support straps 354 and 356 against portions of the bracket and ring portion 308. More specifically, after the end portions of the third and fourth support straps 354 and 356 are inserted through the ring portion 324, the clasp 360 is attached using the fasteners 362 to the bracket and ring portion 308 in order clamp these end portions in position. In doing so, the end portions of the third and fourth support straps 354 and 356 are effectively sandwiched between the clamp portion 326 and the bracket portion 322. The first and second support straps 350 and 352 also can be attached to the bracket and ring portion 308 in a similar manner.

Figure 31:
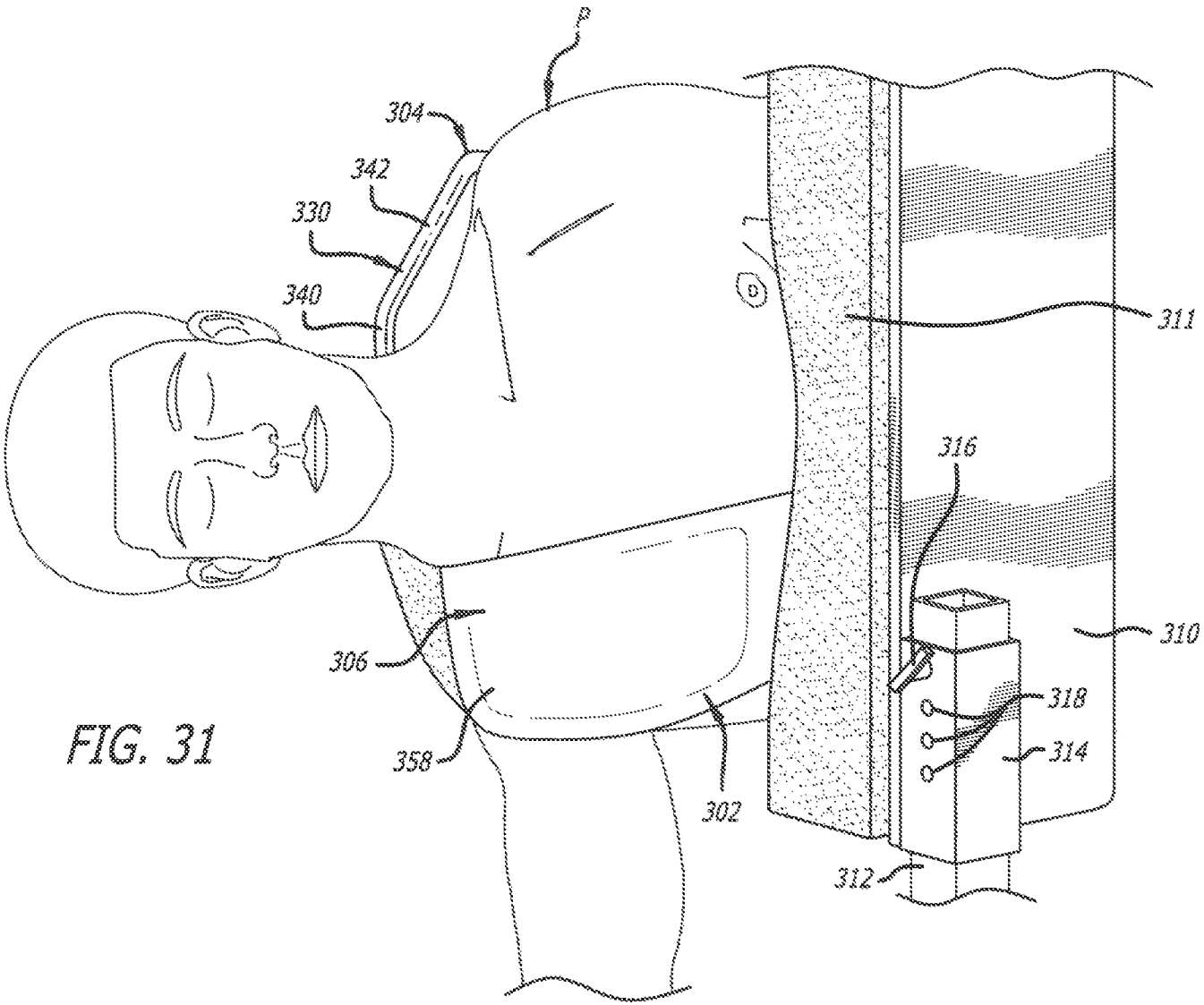
FIG. 31 is a side elevational view of the chest, the head, the shoulders, the upper arms from the anterior side of the patient and a portion of the torso-sling and a chest support structure supporting the patient in the lateral position with respect to the surgical frame.

A fifth support strap 358, like the first, second, third, and fourth support straps 350, 352, 354, and 356, can be used in conjunction with the support frame 304 to hang a portion of the patient's torso on the surgical frame 300. As depicted in FIGS. 30-32, the fifth support strap 358 extends from the transition portion 330 and contacts the patient P as the fifth support strap 358 extends to the second support strap 352. More specifically, the fifth support strap 358 extends from the second member 344 of the transition portion 330, contacts the patient's neck and right shoulder, and is attached to the second support strap 352 adjacent the patient's upper anterior torso at 364. As such, the fifth support strap 358 serves to cradle portions of the patient's neck and right shoulder. To facilitate cradling of portions of the patient P, the fifth support strap 358 can be formed as a loop that can be received on the support frame 304. The loop of the fifth support strap 358 should be strong enough to hold at least a portion of the weight of the patient P, and can be fixed or formed by the above-described fastening mechanisms.

The first, second, third, fourth, and fifth support straps 350, 352, 354, 356, and 358 can have different thicknesses and be padded along their lengths. For example, the third, fourth, and fifth support straps 354, 356, and 358 can be thicker and padded where these support straps are contacted to the patient P.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

We claim:

1. A surgical frame for supporting a patient, the surgical positioning frame comprising:

a main beam for supporting at least a portion of the body of the patient relative thereto, the main beam including a first end, a second end, and a length extending between the first and second ends, a first arm support and a second arm support attached to the main beam, the first and second arm supports configured to support portions of the arms of the patient, a leg support attached to the main beam, the leg support configured to support portions of the legs of the patient;

a chest support plate and a torso-sling including a support bracket configured to support portions of the torso of the patient, the chest support plate being attached to the main beam, the support bracket being attached to the chest support plate, and the torso-sling being supported by the support bracket, the torso-sling being configured to support portions of the torso of the patient, the torso-sling including a frame portion, at least a first support strap, and at least a second support strap, the frame portion including a first side portion, a second side portion, and a transition portion joining the first and second side portions together, the first side portion being configured for positioning adjacent a first lateral side on the posterior side of the patient, the second side portion being configured for positioning adjacent a second lateral side on the posterior side of the patient, and the transition portion being configured for positioning adjacent the neck and shoulders on the posterior side of the patient, the first support strap extending from the support bracket to the first side portion, the first support strap, when the patient is supported by the surgical frame and the torso-sling supports the portions of the torso of the patient, extending in part adjacent portions of the first lateral side of the torso of the patient, the second support strap extending from the support bracket to the second side portion, the second support strap, when the patient is supported by the surgical frame and the torso-sling supports the portions of the torso of the patient, extending in part adjacent and contacting portions of the second lateral side of the torso and the anterior torso of the patient.

2. The surgical frame of claim 1, wherein the first side portion, the second side portion, and the transition portion define an access area therebetween, the access area, when the patient is supported by the surgical frame and the torso-sling supports the portions of the torso of the patient, affording access to the posterior torso of the patient.

3. The surgical frame of claim 1, wherein the torso-sling serves to hang portions of the torso of the patient from the support bracket.

4. The surgical frame of claim 1, further comprising at least a third support strap, the third support strap, when the patient is supported by the surgical frame and the torso-sling supports the portions of the torso of the patient, extending from the transition portion to the second support strap.

5. The surgical frame of claim 4, wherein, when the patient is supported by the surgical frame and the torso-sling supports the portions of the torso of the patient, the third support strap extends in part adjacent and contacting portions of the shoulder adjacent the second lateral side of the torso of the patient.

6. The surgical frame of claim 1, further comprising a first support portion, a second support portion, and at least one connecting member, the first support portion supporting the main beam at the first end thereof, and the second support portion supporting the main beam at the second end thereof, and the at least one connecting member connecting the first and second support portions to one another.

7. The surgical frame of claim 6, wherein the main beam is rotatably supported relative to the first support portion and the second support portion, the main beam being rotatable between a first position and a second position.

8. A surgical frame for supporting a patient, the surgical positioning frame comprising:

a main beam for supporting at least a portion of the body of the patient relative thereto, the main beam including a first end, a second end, and a length extending between the first and second ends, a chest support plate and a torso-sling including a support bracket configured to support portions of the torso of the patient, the chest support plate being attached to the main beam, the support bracket being attached to the chest support plate, and the torso-sling being supported by the support bracket, the torso-sling being configured to support portions of the torso of the patient, the torso-sling including a frame portion, at least a first support strap, and at least a second support strap, the frame portion including a first side portion, a second side portion, and a transition portion joining the first and second side portions together, the first side portion being configured for positioning adjacent a first lateral side on the posterior side of the patient, the second side portion being configured for positioning adjacent a second lateral side on the posterior side of the patient, and the transition portion being configured for positioning adjacent the neck and shoulders on the posterior side of the patient, the first side portion, the second side portion, and the transition portion defining an access area therebetween, the access area, when the patient is supported by the torso-sling, affording access to the posterior torso of the patient, the first support strap extending from the support bracket to the first side portion, the first support strap, when the patient is supported by the surgical frame and the torso-sling supports the portions of the torso of the patient, extending in part adjacent portions of the first lateral side of the torso of the patient, the second support strap extending from the support bracket to the second side portion, the second support strap, when the patient is supported by the surgical frame and the torso-sling supports the portions of the torso of the patient, extending in part adjacent and contacting portions of the second lateral side of the torso and the anterior torso of the patient.

9. The surgical frame of claim 8, further comprising a first arm support, a second arm support, and a leg support attached to the main beam, the first and second arm supports configured to support portions of the arms of the patient, and the leg support configured to support portions of the legs of the patient.

10. The surgical frame of claim 8, wherein the torso-sling serves to hang portions of the torso of the patient from the support bracket.

11. The surgical frame of claim 8, further comprising at least a third support strap, the third support strap, when the patient is supported by the surgical frame and the torso-sling supports the portions of the torso of the patient, extending from the transition portion to the second support strap.

12. The surgical frame of claim 11, wherein, when the patient is supported by the surgical frame and the torso-sling supports the portions of the torso of the patient, the third support strap extends in part adjacent and contacting portions of the shoulder adjacent the second lateral side of the torso of the patient.

13. The surgical frame of claim 8, further comprising a first support portion, a second support portion, and at least one connecting member, the first support portion supporting the main beam at the first end thereof, and the second support portion supporting the main beam at the second end thereof, and the at least one connecting member connecting the first and second support portions to one another.

14. The surgical frame of claim 13, wherein the main beam is rotatably supported relative to the first support portion and the second support portion, the main beam being rotatable between a first position and a second position.

15. A surgical frame for supporting a patient, the surgical positioning frame comprising:

a main beam for supporting at least a portion of the body of the patient relative thereto, the main beam including a first end, a second end, and a length extending between the first and second ends, a chest support plate and a torso-sling including a support bracket configured to support portions of the torso of the patient, the chest support plate being attached to the main beam, and the torso-sling being supported relative to the chest support plate, the torso-sling being configured to support portions of the torso of the patient, the torso-sling including a frame portion, at least a first support strap, and at least a second support strap, the frame portion including a first side portion for positioning adjacent a first lateral side of the patient, a second side portion for positioning adjacent a second lateral side of the patient, and a transition portion joining the first and second side portions together, the first side portion, the second side portion, and the transition portion defining an access area therebetween, the access area, when the patient is supported by the torso-sling, affording access to the posterior torso of the patient, the first support strap extending from the support bracket to the first side portion, the first support strap, when the patient is supported by the surgical frame and the torso-sling supports the portions of the torso of the patient, extending in part adjacent portions of the first lateral side of the torso of the patient, the second support strap extending from the support bracket to the second side portion, the second support strap, when the patient is supported by the surgical frame and the torso-sling supports the portions of the torso of the patient, extending in part adjacent and contacting portions of the second lateral side of the torso and the anterior torso of the patient.

16. The surgical frame of claim 15, wherein the torso-sling serves to hang portions of the torso of the patient from the support bracket.

17. The surgical frame of claim 15, further comprising at least a third support strap, the third support strap, when the patient is supported by the surgical frame and the torso-sling supports the portions of the torso of the patient, extending from the transition portion to the second support strap.

18. The surgical frame of claim 17, wherein, when the patient is supported by the surgical frame and the torso-sling supports the portions of the torso of the patient, the third support strap extends in part adjacent and contacting portions of the shoulder adjacent the second lateral side of the torso of the patient.

19. The surgical frame of claim 15, further comprising a first support portion, a second support portion, and at least one connecting member, the first support portion supporting the main beam at the first end thereof, and the second support portion supporting the main beam at the second end thereof, and the at least one connecting member connecting the first and second support portions to one another.

20. The surgical frame of claim 19, wherein the main beam is rotatably supported relative to the first support portion and the second support portion, the main beam being rotatable between a first position and a second position.

* * * * *